US011603844B2

(12) United States Patent
Csányi

(10) Patent No.: US 11,603,844 B2
(45) Date of Patent: Mar. 14, 2023

(54) CENTRIFUGAL PUMP

(71) Applicant: GRUNDFOS HOLDING A/S, Bjerringbro (DK)

(72) Inventor: Róbert Csányi, Bjerringbro (DK)

(73) Assignee: GRUNDFOS HOLDING A/S, Bjerringbro (DK)

( * ) Notice: Subject to any disclaimer, the term of this patent is extended or adjusted under 35 U.S.C. 154(b) by 0 days.

(21) Appl. No.: 17/415,351

(22) PCT Filed: Dec. 19, 2019

(86) PCT No.: PCT/EP2019/086375
§ 371 (c)(1),
(2) Date: Jun. 17, 2021

(87) PCT Pub. No.: WO2020/127782
PCT Pub. Date: Jun. 25, 2020

(65) Prior Publication Data

US 2022/0056911 A1 Feb. 24, 2022

(30) Foreign Application Priority Data

Dec. 21, 2018 (EP) ..... 18215565

(51) Int. Cl.
*F04D 7/04* (2006.01)
*F04D 29/22* (2006.01)
*F04D 29/42* (2006.01)

(52) U.S. Cl.
CPC ..... *F04D 7/04* (2013.01); *F04D 29/2294* (2013.01); *F04D 29/42* (2013.01)

(58) Field of Classification Search
CPC ..... F04D 7/04; F04D 29/2294; F04D 29/4293
See application file for complete search history.

(56) References Cited

U.S. PATENT DOCUMENTS 3,096,718 A * 7/1963 Anderson ..... F04D 7/045 241/185.6
3,447,475 A * 6/1969 Blum ..... F04D 29/167 416/185

(Continued)

FOREIGN PATENT DOCUMENTS

DE 240 859 C 11/1911
EP 1 357 294 B1 7/2018

(Continued)

OTHER PUBLICATIONS

C. Pfleiderer, "Die Kreiselpumpen (auszug)" In: "Die Kreiselpumpen, 2. Auflage", Jan. 1, 1932 (Jan. 1, 1932), XP055578377, p. 418, Abb. 306, Seite 418.

*Primary Examiner* — Woody A Lee, Jr.
*Assistant Examiner* — Brian O Peters
(74) *Attorney, Agent, or Firm* — McGlew and Tuttle, P.C.

(57) ABSTRACT

A centrifugal pump (1) including: a pump housing (3) enclosing a pump chamber (13), the pump chamber (13) including a suction inlet (15) and a pressure outlet (17); an impeller (19) rotatably arranged within the pump chamber (13) for being driven to rotate about a rotor axis (R), the suction inlet (15) being located coaxial with the rotor axis (R); and at least one stationary scraper (39). The impeller (19) includes an impeller base (31) and at least one or more impeller vanes (33) extending from the impeller base (31) towards the suction inlet (15). Each of the impeller vanes (33) includes a radially innermost vane path (45) describing during impeller rotation a central volume (41) that is wider towards the suction inlet (15) than towards the impeller base (31) and configured to receive the at least one scraper (39) projecting from the suction inlet (15) into the central volume (41).

18 Claims, 18 Drawing Sheets

(56) References Cited

U.S. PATENT DOCUMENTS

| | | | | |
|---|---|---|---|---|
| 4,896,445 | A * | 1/1990 | Deal | E02F 3/88 37/329 |
| 9,869,326 | B2 * | 1/2018 | Stark | F04D 29/426 |

FOREIGN PATENT DOCUMENTS

| | | | |
|---|---|---|---|
| GB | 812 371 | A | 4/1959 |
| JP | S50 50602 | U | 5/1975 |
| JP | S53 57507 | A | 5/1978 |
| WO | 2006/135304 | A1 | 12/2006 |
| WO | 2007/004943 | A1 | 1/2007 |

* cited by examiner

CENTRIFUGAL PUMP

CROSS REFERENCE TO RELATED APPLICATIONS

This application is a United States National Phase Application of International Application PCT/EP2019/086375, filed Dec. 19, 2019, and claims the benefit of priority under 35 U.S.C. § 119 of European Application 18215565.5, filed Dec. 21, 2018, the entire contents of which are incorporated herein by reference.

TECHNICAL FIELD

The present invention pertains generally to centrifugal pumps, in particular to centrifugal pumps for pumping wastewater, sewage or other fluids containing solid, fibrous and/or viscous substances with a tendency to cause clogging in the centrifugal pump.

TECHNICAL BACKGROUND

Sewage or wastewater collection systems for wastewater treatment plants typically comprise one or more wastewater pits, wells or sumps for temporarily collecting and buffering wastewater. Typically, wastewater flows into such pits passively under gravity flow and/or actively driven through a force main. One, two or more pumps are usually installed in or at each pit to pump wastewater out of the pit. If the inflow of wastewater is larger than the outflow for a certain period of time, the wastewater pit or sump will eventually overflow. Such overflows should be prevented as much as possible in order to avoid environmental impact. Therefore, the risk of pump clogging should be avoided as much as possible.

EP 1 357 294 B1 describes a sewage pump with impeller vanes, wherein the ridges of the impeller vanes extend from a central hub radially outward along a spiral with decreasing height. A scraper protrudes radially inward from the pump housing and has a plane surface in parallel with the vane ridges to guide pollutants off the vane ridges towards grooves in the pump housing.

That known solution has the disadvantage that the vane ridges act as leading edges on which in particular fibrous substances can easily get hooked and agglomerate. If larger amounts of fibrous substances simultaneously hit the vane ridges, the scraper is not able to guide and transport them quickly enough into and through the grooves. This results in pump clogging and a possible sump overflow.

It is thus a technical challenge to improve a centrifugal pump in such a way that the risk of pump clogging is reduced when larger amounts of fibrous substances hit the impeller simultaneously.

SUMMARY

In contrast to known systems, embodiments of the present disclosure provide a centrifugal pump that solves this problem.

In accordance with the present disclosure, a centrifugal pump is provided comprising:

- a pump housing defining a pump chamber, wherein the pump chamber comprises a suction inlet and a pressure outlet,
- an impeller rotatably arranged within the pump chamber for being driven to rotate about a rotor axis, wherein the suction inlet is located coaxial with the rotor axis, and
- at least one stationary scraper, wherein the impeller comprises an impeller base and one or more impeller vanes extending from the impeller base towards the suction inlet, wherein each of the impeller vanes comprises a radially innermost vane path describing during impeller rotation a central volume that is wider towards the suction inlet than towards the impeller base and that is configured to receive the at least one scraper projecting from the suction inlet into the central volume.

In contrast to the sewage pump described in EP 1 357 294 B1, it is not the vane ridge that is scraped off by a plane scraper. Instead, the impeller vanes have a geometry that describes during impeller rotation a central volume into which the scraper protrudes essentially axially. During impeller rotation, the radially innermost vane paths of the impeller vanes follow a virtual surface of revolution enclosing at least partially the central volume. The virtual surface of revolution may have a shape of a full or truncated dome, bell and/or cone. The surface of revolution, defined by the shape of the radially innermost vane path, may be curvy, convex, concave and/or straight in a radial cut. The central volume is able to cope with a larger inflow of fibrous substances without pump clogging, because of the relatively large open space of the impeller and the scraping effect of the scraper.

Optionally, the at least one scraper may comprise a radially outward scraper surface acting as a first scraping path and positioned to form a scrape gap to the radially innermost vane path acting as a second scraping path. It should be noted that a normal vector of the first scraping path has a radially outwardly directed vector component, whereas the second scraping path has a radially inwardly directed vector component. During impeller rotation, the second scraping path of the impeller vanes passes the first scraping path of the scraper and fibrous substances are thereby hydrodynamically pushed off and away by the created flow. The surfaces of the scraper and the impeller vanes thus interact with each other during impeller rotation in order to push fibrous substances away and prevent the fibrous substances from clogging and being caught on the impeller vanes.

Contrary to other known centrifugal pumps, the centrifugal pump according to the present disclosure does not work by cutting or tearing the fibrous material. Such cutting for one reason is not desirable, because it would consume a considerable amount of power provided by a motor driving the impeller. Rather, as mentioned previously, the positioning of the scraper relative to the vanes of the impeller has been seen in tests to create a flow which hydrodynamically pushes the fibrous substances away in the desired directions and thereby scrapes the fibers off the impeller vanes. In addition, the scraper physically "collects" the fibers near the impeller base and facilitates a transport of the fibers away from the impeller base towards the vane ridges, where it can exit through one or more grooves.

A further advantage of the at least one scraper is that the negative effects of fluid prerotation or swirl at the suction inlet, in particular at low flow, are alleviated. The risk of prerotation is reduced by the presence of the scraper as described herein. As a consequence, the average head loss induced by prerotation is reduced by the scraper.

The scrape gap may be designed large enough to avoid or reduce a cutting effect for fibrous substances or a clogging and small enough to provide an effective pushing and scraping effect. The scrape gap may thus be in the range of 0.1 to 5 mm, preferably in the range of 0.3 to 2 mm, most preferably approximately 1 mm. In order to scrape off fibers accumulating at or close to the rotor axis, it is preferred that the scraper is long enough to extend close to the impeller base. Preferably, the height in axial direction of the at least one scraper is at least 50% of the depth in axial direction of the central volume.

Optionally, the scrape gap may be adjustable by adjusting the axial position of the impeller and/or the scraper. This is beneficial to be able to trim the centrifugal pump to the desired needs and expected amounts and kind of fibrous substances in the pumped fluid. Alternatively, or in addition, the scraper may be fixed as an integral part of a suction inlet, e.g. as a molded part.

Optionally, the scrape gap may be constant or may vary along the radially innermost vane path, e.g. it may increase or decrease towards the impeller base. If the scrape gap increases towards the impeller base, the scraping effect decreases with the proximity to the impeller base. This may be beneficial for the integrity of the scraper, i.e. to compensate a higher moment of scraping force acting on the scraper end facing the impeller base.

Optionally, the first scraping path and/or the second scraping path may be a part of a machined surface. This may be advantageous in order to precisely define the scrape gap. Alternatively, in order to avoid as many sharp edges as possible for reducing the risk of cavitation effects, the first scraping path and/or the second scraping path may be simply defined as the radially outermost surface path and/or the radially innermost surface path, respectively, without the need of a machined surface.

Optionally, in order to prevent fibrous substances from getting entangled at the scraper, the scraper may be mounted to or be an integral part of the suction inlet with a scraper connection angle in the range of 110° to 170°. The scraper connection angle may be defined by the obtuse angle between a tangent at the radially outermost point of a scraper ridge and an axis parallel to the rotor axis through that point. The scraper ridge may act as a scraper leading edge for fluid inflow through the suction inlet and may be a path on a preferably rounded scraper surface from the suction inlet towards the impeller base, whereby the fluidic resistance of the scraper is reduced.

Optionally, the at least one scraper may comprise a guiding surface facing essentially backward in circumferential direction of impeller rotation, i.e. a normal vector on the guiding surface has a vector component directed backwardly in circumferential direction of impeller rotation. The guiding surface may extend essentially straight in an axial direction or may be backwardly inclined in the direction of impeller rotation from the suction inlet towards the impeller base. The guiding surface may be concave in one or more directions. The guiding surface may thereby efficiently guide fibrous substances radially outward, preferably into an inlet port of a groove for transporting the fibrous substances outward.

Optionally, each vane may comprise a vane ridge surface facing towards a cover surface of the suction inlet, wherein the impeller is positioned relative to the cover surface to form a cover gap between the vane ridge surface and the cover surface. The cover surface of the suction inlet may be defined by a suction cover in form of a collar of the suction inlet. The vane ridge surface is thus covered and shielded by the cover surface of the suction inlet, so that no fibrous substances directly hit on the vane ridges. The vane ridge surface is preferably machined in order to precisely define the cover gap.

The cover gap may be designed large enough to reduce the frictional effects of fibrous substances squeezed between them and small enough to increase the pumping effect. Preferably, the cover gap may be in the range of 0.1 to 1 mm, preferably approximately 1 mm.

Optionally, the cover gap may be adjustable by adjusting the axial position of the impeller and/or the cover surface. This is beneficial to be able to trim the centrifugal pump to the desired needs and expected amounts and kind of fibrous substances in the pumped fluid.

Optionally, the cover surface may comprise at least one groove extending from a groove inlet port at an inner radius of the cover surface to a groove outlet port at an outer radius of the cover surface. Fibrous substances can enter the groove(s) at the inlet port and are then pushed radially outward along the groove(s) to exit the groove(s) at the outlet port, where they are ejected out of the pump through the pressure outlet.

Optionally, in case of more than one groove, the $n \geq 2$ grooves may be arranged in a n-fold rotational symmetry with respect to the rotor axis, wherein $n \in \mathbb{N}$.

Optionally, the inlet port of a groove may be located at a first angular position and the outlet port of said groove at a second angular position, wherein the second angular position ($\varphi_2$) is located further forward in circumferential direction of rotation than the first angular position ($\varphi_1$). For instance, the groove(s) may follow a spiraling path in form of an outward volute from the inlet port to the outlet port.

Optionally, the width and/or depth of the groove(s) may increase from the groove inlet port towards the groove outlet port.

Optionally, at least a first section of the groove(s), preferably a radially inner section of the groove(s), may be curved in form of a spiral section with a radial growth of $$\frac{dr}{d\varphi} \leq \frac{r_2 - r_1}{45°}.$$

Optionally, at least a second section of the groove(s), preferably a radially outer section of the groove(s), may be curved in form of a spiral section with a radial growth of $$\frac{dr}{d\varphi} \geq \frac{r_2 - r_1}{20°}.$$

Optionally, the groove outlet port(s) may have an angular position ($\varphi_2$) in the range $20° \leq \varphi_2 \leq 310°$, wherein an angular position of $(\varphi_1)_2 = 0°$ corresponds to the angular position of the pressure outlet.

Optionally, the guiding surface of the at least one scraper may be located at an angular distance of less than 90° forward in circumferential direction of impeller rotation from an inlet port of at least one of the grooves. Thereby, the fibrous substances are first scraped off the second scraping paths of the vanes and then transported radially outward along the guiding surface, which effectively guides the fibrous substances into the inlet port of the groove. Preferably, the inlet port of at least one of the grooves extends between a first angular end and a second angular end, wherein the angular distance between the first angular end and the second angular end is less than 90°. The at least one guiding surface of the at least one scraper may be located at the second angular end of said inlet port, wherein the second angular end is located behind the first angular end in circumferential direction of impeller rotation.

Optionally, each of the impeller vanes may comprise a leading edge extending from a leading edge base point at the impeller base to a leading edge ridge point at a vane ridge surface, wherein the leading edge is backwardly swept from the leading edge base point to the leading edge ridge point. It should be noted that the terms "backwardly swept" or "backward sweep" at a point of the leading edge shall mean herein that a tangent plane at that point is tilted "backward" in circumferential direction of rotation with respect to a plane extending along the rotor axis and through that point. The backward sweep transports fibrous substances towards the leading edge ridge point, where it can be effectively scraped off by the scraper. It should be noted that the leading edge does not need to be an "edge" in the geometrical sense, but may be a path on a smoothly curved surface. The leading edge is to be understood in the fluid-dynamical sense as the path of most-forwardly located vane surface points which hit the fluid first upon impeller rotation.

Optionally, the leading edge is swept backwardly by a leading edge sweep angle of at least 20° at the leading edge ridge point. It should be noted that a "backward sweep of vane ridges" as described in EP 1 357 294 B1 has a sweep angle above 90° in the above definition of "backward sweep", i.e. each point of the vane ridge has a normal vector with a vector component directed backwardly in circumferential direction. In contrast to that, the impeller vanes described herein may comprise a leading edge, wherein each point of the leading edge has a normal vector with a vector component directed forwardly in circumferential direction.

Optionally, the radially innermost vane surface acting as the second scraping path may extend to the leading edge, or at least a first section thereof. Thereby, at least the first section of the leading edge can be scraped off by the scraper. Preferably, the first section of the leading edge extends to the leading edge ridge point. A second section of the leading edge may extend from the leading edge base point to the first section. Optionally, the leading edge sweep angle may be larger in the second section of the leading edge than in the first section of the leading edge. Alternatively, the leading edge may have no surface points in common with the radially innermost vane surface acting as the second scraping path. In such an embodiment, the leading edge may have a distance in radial and/or circumferential direction from the radially innermost vane path. Optionally, such a distance in radial and/or circumferential direction between the leading edge and the radially innermost vane path may increase towards the impeller base. Such an embodiment is particularly beneficial to reduce the risk of cavitation effects and to optimize the fluid-dynamic shape of the impeller vanes.

Optionally, the leading edge sweep angle may be larger at the leading edge base point than at the leading edge ridge point, wherein the leading edge sweep angle may be least 20° between the leading edge base point and the leading edge ridge point. The leading edge sweep angle at the leading edge base point may be 90°, i.e. there may be effectively no sweep at the leading edge base point.

Optionally, each of the impeller vanes may be radially outwardly tilted from the impeller base to the vane ridge surface by a tilt angle of up to 60°, preferably up to 20°. The tilt angle may vary from the leading edge to the trailing edge and/or from the impeller base to the vane ridge. In case it varies, the tilt angle shall be defined at the radially innermost vane path and at the vane ridge.

Optionally, the vanes may be curved in form of a spiral section between the leading edge and a trailing edge in a plane perpendicular to the rotor axis.

Optionally, if the impeller comprises more than one impeller vane, the n 2 vanes may be arranged in a n-fold rotational symmetry with respect to the rotor axis, wherein $n \in \mathbb{N}$.

Optionally, the vane ridge surfaces may be swept backwardly by a vane ridge sweep angle above 90° from the leading edge ridge point to the trailing edge, i.e. a normal vector of the vane ridge surfaces has a vector component directed backwardly against circumferential direction of impeller rotation.

Optionally, the radially innermost vane path may comprise a first section having a convex shape and a second section having a concave shape. This may result in a bell-shaped central volume that is described by the radially innermost vane path during impeller rotation. Such as bell-shape facilitates the radially outward motion of fibers towards the groove inlet port(s).

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF PREFERRED EMBODIMENTS

Figure 1:
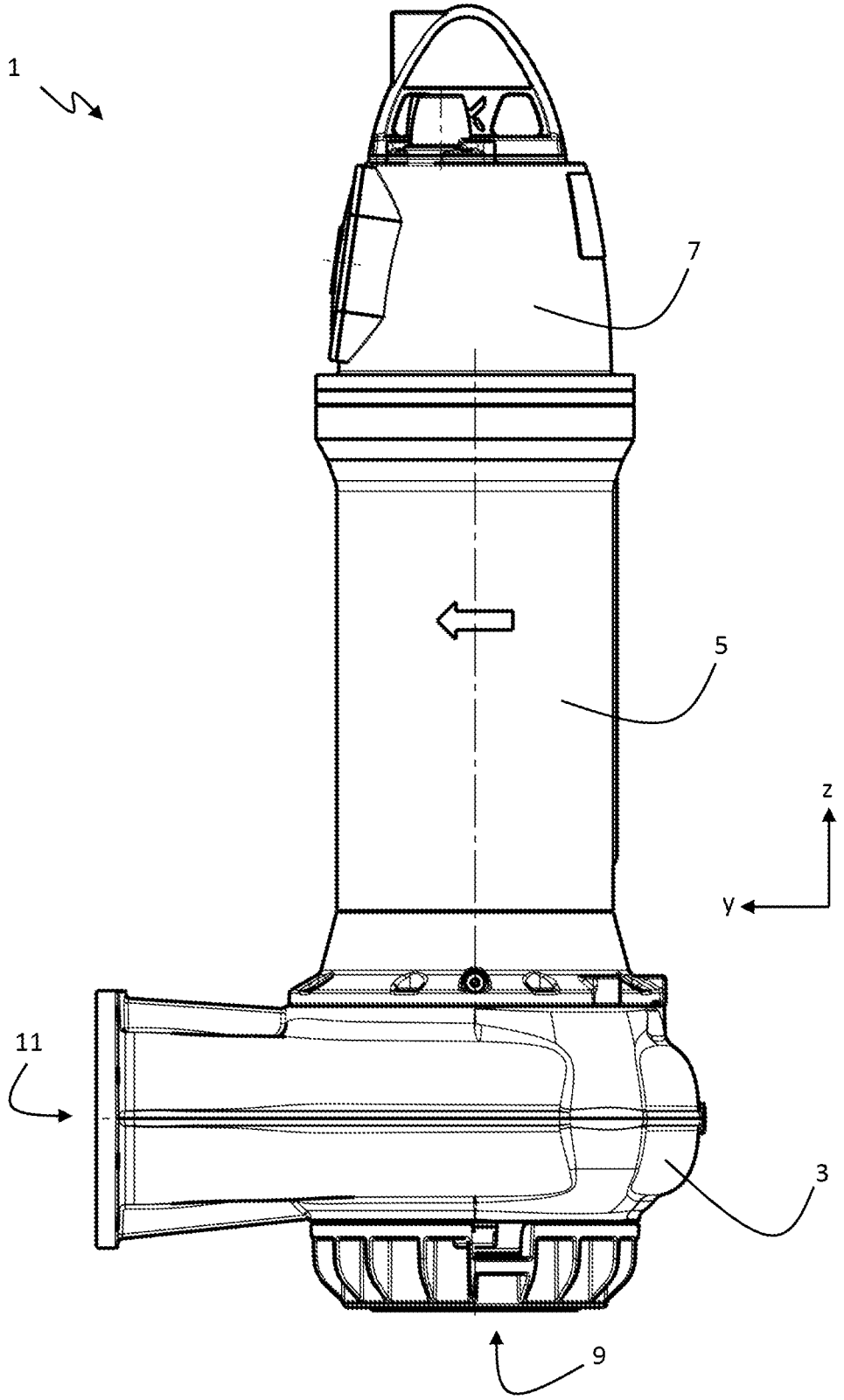
FIG. 1 is a front view on an embodiment of a pump housing of a centrifugal pump according to the present disclosure.

Referring to the drawings, FIG. 1 shows an elongate centrifugal pump 1 as a submersible wastewater pump that can be submersed into a wastewater pit or a duct to pump wastewater with fibrous substances. The pump 1 comprises a pump housing 3, a motor housing 5 and an electronics housing 7 arranged essentially along a vertical rotor axis R, wherein the motor housing 5 is arranged between the pump housing 3 and the electronics housing 7. The pump housing defines a fluid inlet 9 and a fluid outlet 11. The fluid inlet 9 is here a bottom opening in the pump housing 3, wherein the bottom opening is coaxial with the rotor axis R.

It should be noted that the vertical pump setup shown herein is only a preferred setup. The rotor axis R may extend vertically or horizontally or in any other direction. For the sake of convenience, a right-handed Cartesian coordinate system is given in each figure, wherein the z-axis extends along the rotor axis R, i.e. here vertically upwards, the y-axis extends sideways out of the fluid outlet 11, and the x-axis extends forward. The terms "top", "bottom", "front" and "rear" thus refer to respective directions along the z-axis or x-axis. The direction of impeller rotation is here counter-clockwise about the rotor axis R when seen from the bottom upwards in z-direction.

Figure 2:
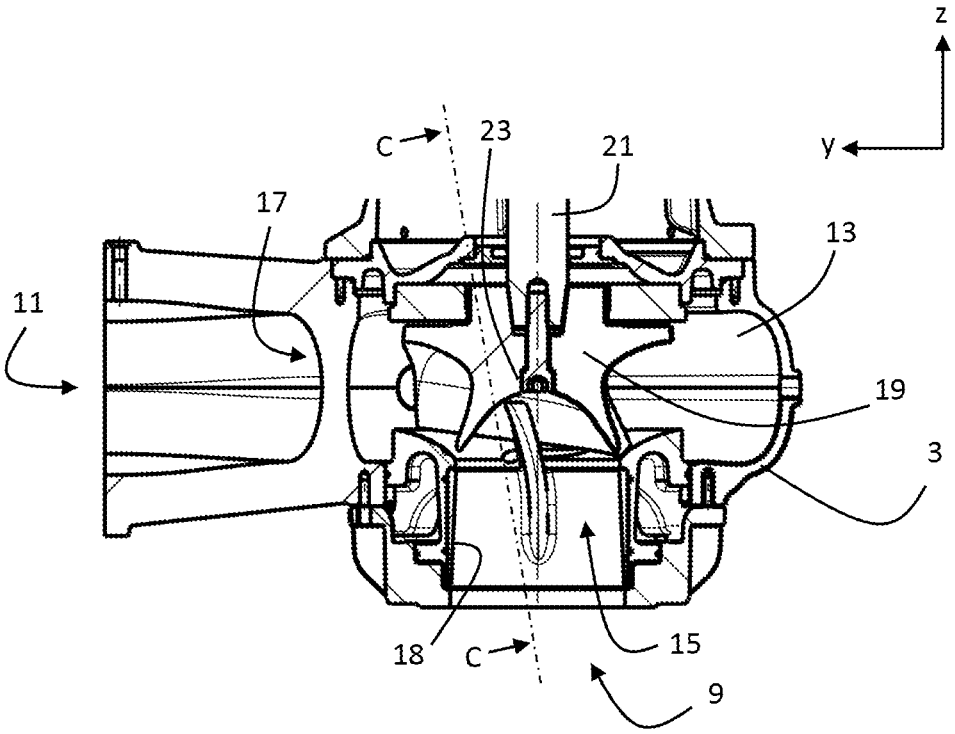
FIG. 2 is a longitudinal sectional view on the embodiment as shown in FIG. 1.

FIG. 2 shows that the pump housing 3 encloses a pump chamber 13 comprising a suction inlet 15 and a pressure outlet 17, wherein the suction inlet 15 comprises here an inlet sleeve 18 being coaxially arranged with the rotor axis R and extending from the fluid inlet 9 to the pump chamber 13. The pressure outlet 17 of the pump chamber 13 is arranged radially outward in lateral y-direction. An impeller 19 is rotatably arranged within the pump chamber 13 for being driven to rotate about the rotor axis R. A rotor axle 21 is fixed to a central hub 23 of the impeller 19 and extends upwards in z-direction along the rotor axis R out of the pump housing 3 into the motor housing 5, which is attached to the top of the pump housing 3.

Figure 3:
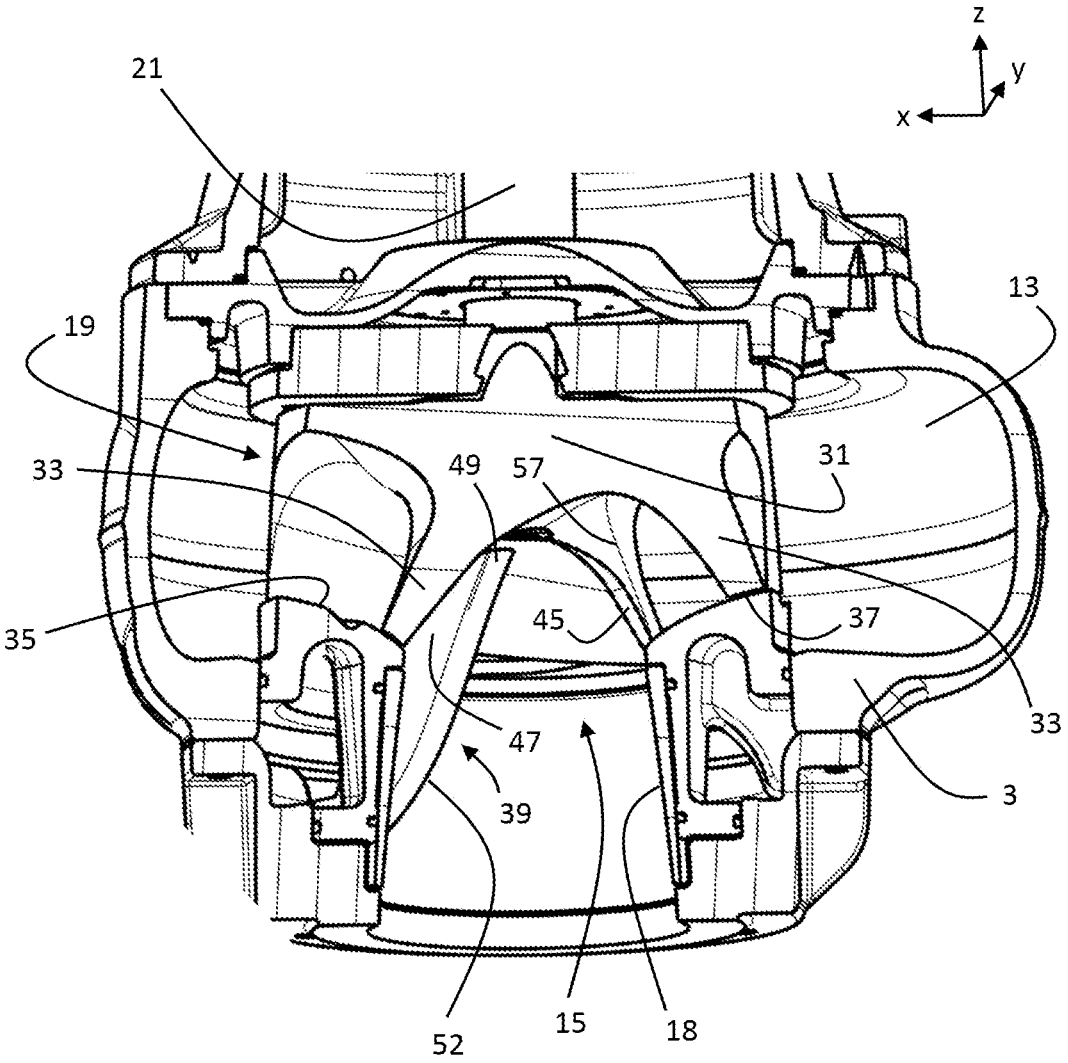
FIG. 3 is a detail sectional view on plane C-C as outlined in FIG. 2.

FIG. 3 shows the pump chamber 13 in more detail when seen essentially in negative y-direction from the fluid outlet 11. The impeller 19 comprises an upper impeller base 31 from which two impeller vanes 33 extend downward towards the suction inlet 15. The suction inlet 15 widens towards the impeller 19 by means of a slightly convexly shaped cover surface 35 arranged at the upper end of the inlet sleeve 18. Each of the impeller vanes 33 comprises a vane ridge surface 37 facing the cover surface 35 with a cover gap h of 0.1 to 1 mm, e.g. approximately 1 mm, between them (see FIG. 4). The vane ridge surfaces 37 slide along the cover surface 35 upon rotation of the impeller 19. A scraper 39 in form of a finger projects essentially upward into a central dome-shaped volume 41 (see FIG. 5) described by impeller rotation and which is not crossed by the impeller vanes 33 during impeller rotation. The central dome-shaped volume 41 has the largest radius of essentially the inner radius of the inlet sleeve 18 at the suction inlet 15 and the smallest radius of essentially the radius of the central hub 23 at the impeller base 31. The scraper 39 is fixed to the inlet sleeve 18 and projects upwards towards the central hub 23 into the dome-shaped volume 41.

Figure 4:
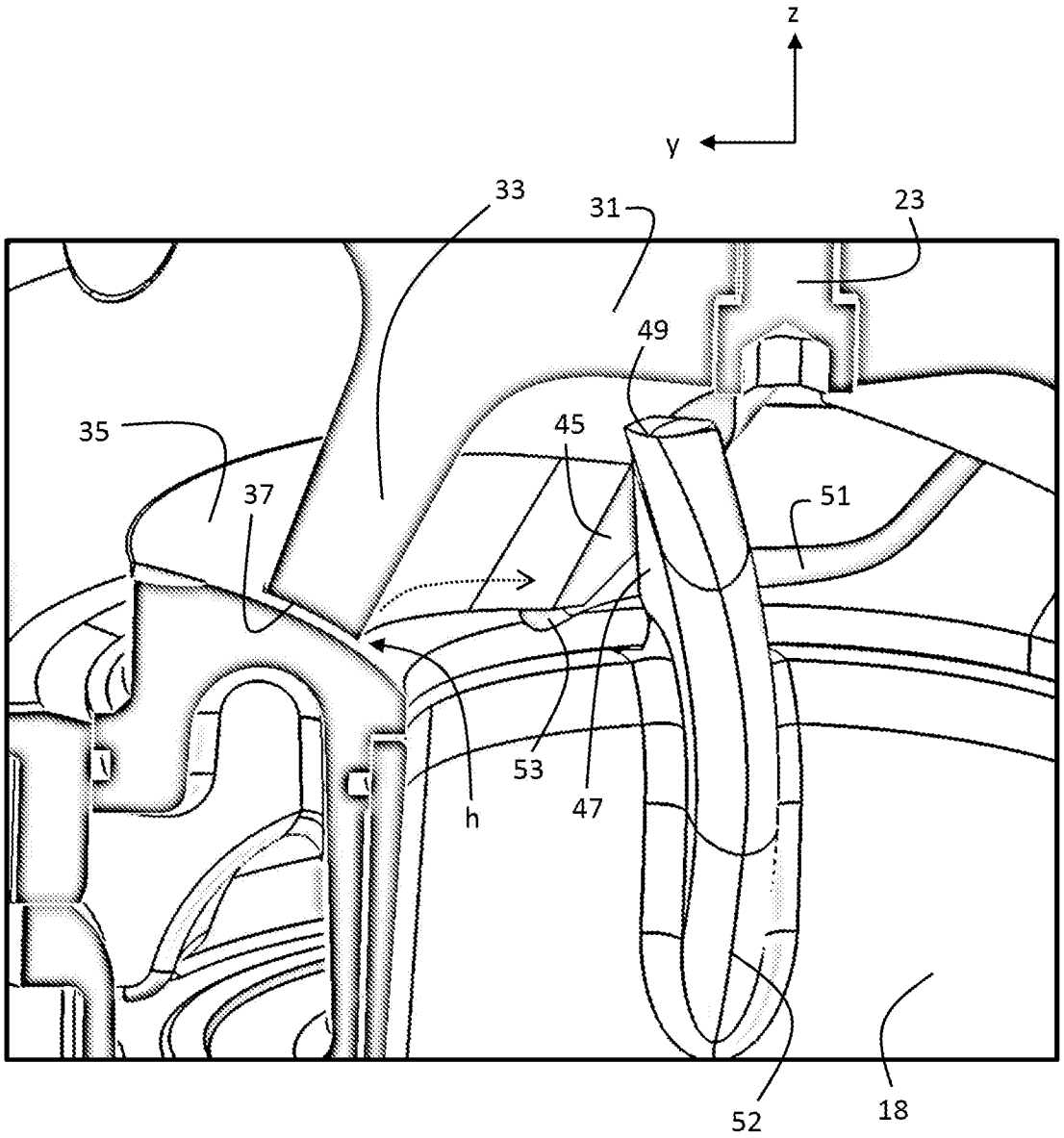
FIG. 4 is a more detailed sectional view showing the interaction of an impeller vane with a scraper according to the present disclosure.

FIG. 4 shows the interaction of the scraper 39 and the impeller 19 in more detail. The scraper 39 comprises a machined radially outward scraper surface 43 acting as a first scraping path 43 and being positioned to form a scrape gap g (best visible in FIG. 8*c* on the right) of 0.1 to 5 mm, e.g. in the range of 0.3 to 2 mm or of approximately 1 mm, to a machined radially innermost vane surface 45 acting as a second scraping path 45. Upon impeller rotation, the second scraping path 45 of the impeller vanes 33 slides along the first scraping path 43 of the stationary scraper 39, whereby fibrous substances are scraped off the second scraping path 45. It is the second scraping path 45 of the impeller vanes 33 that describes the dome-shaped central volume 41 during impeller rotation.

When the impeller rotates, fibrous substances are not cut by the scraper, but rather scraped pushed away by the scraper 39 and by the interaction between the guiding surface 47 of the scraper 39 facing essentially backwardly in circumferential direction of impeller rotation, i.e. here in positive y-direction and the rotating impeller vanes. The guiding surface 47 of the scraper 39, and in this embodiment the scraper 39 as a whole, is inclined backwardly by up to 30° in circumferential direction of impeller rotation, i.e. here in positive y-direction, from the inlet sleeve 18 to a scraper end 49 close to the central hub 23 of the impeller base 31. Except for the first scraping path 43 of the scraper 19, the surfaces of the scraper 39 in general are smoothly curved to reduce the fluidic resistance.

Figure 9:
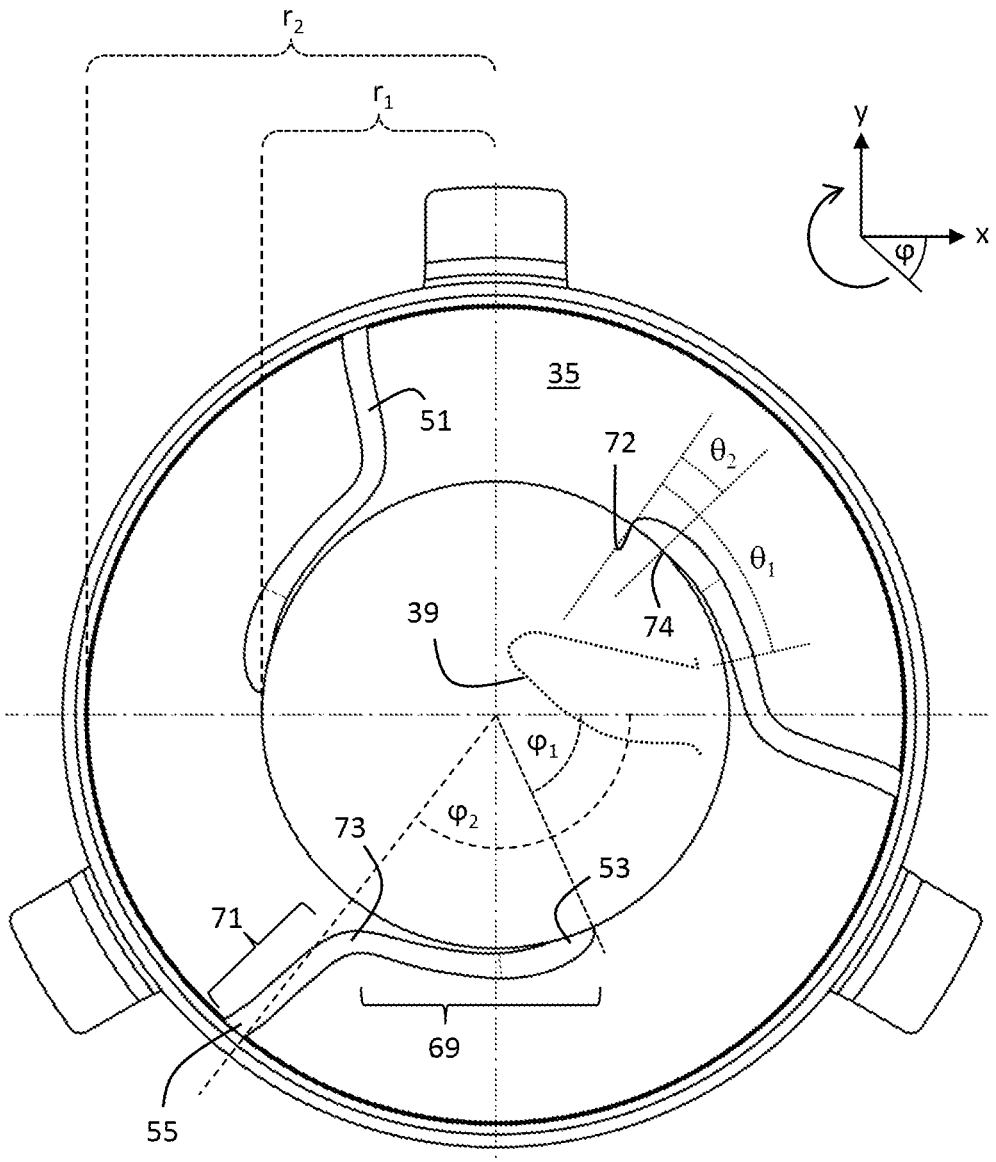
FIG. 9 is a top view of the cover surface of the embodiment of a centrifugal pump according to the present disclosure.
Figure 10:
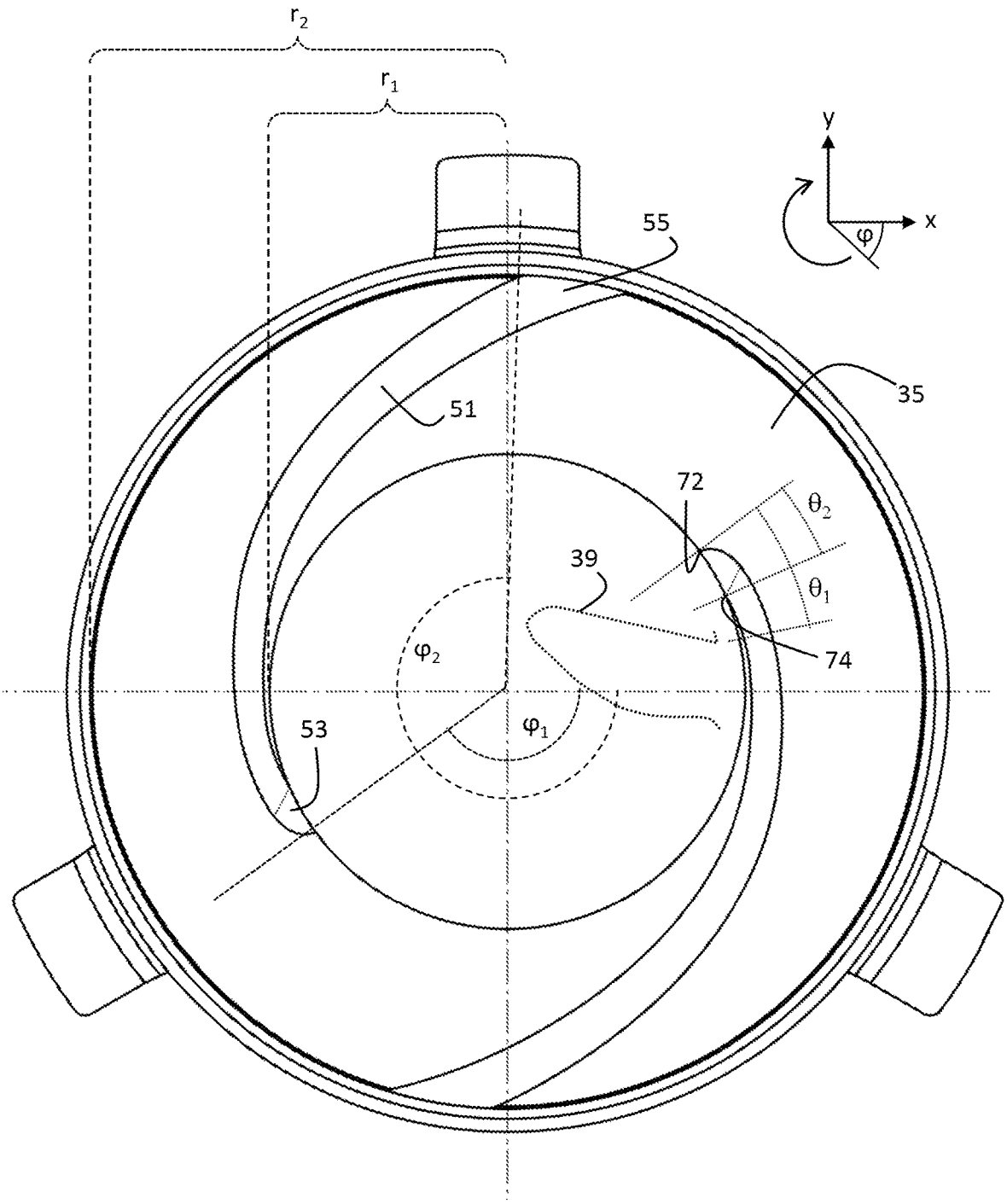
FIG. 10 is a top view of an alternative embodiment of a cover surface of a suction inlet of a centrifugal pump according to the present disclosure.

The scraper 19 guides fibrous substances towards the cover surface 35, which comprises grooves 51 along which fibrous substances can be transported radially outward. Each groove 51 extends from a groove inlet port 53 at an inner radius $r_1$ of the cover surface 35 to a groove outlet port 55 at an outer radius $r_2$ of the cover surface 35 (best visible in FIGS. 9 and 10). The scraper 39 is located relative to the grooves 51 such that the guiding surface 47 is not far behind a groove inlet port 53 of a groove 51, i.e. at an angular distance of less than 90° forward in circumferential direction of impeller rotation, so that the fibrous substances agglomerated at the guiding surface 47 can easily enter the groove 51. This is illustrated in FIGS. 3, 9, and 10.

Figure 5:
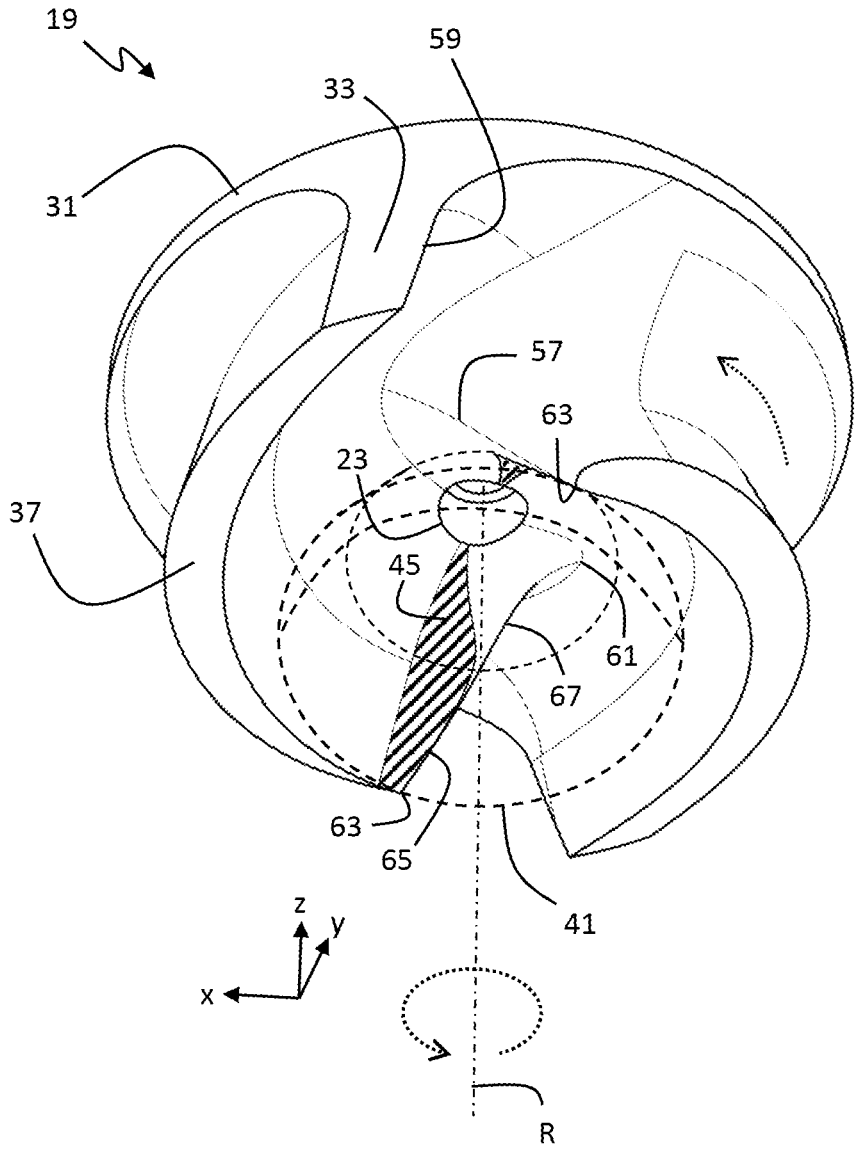
FIG. 5 is a perspective view of an impeller of the embodiment of a centrifugal pump according to the present disclosure.
Figure 6:
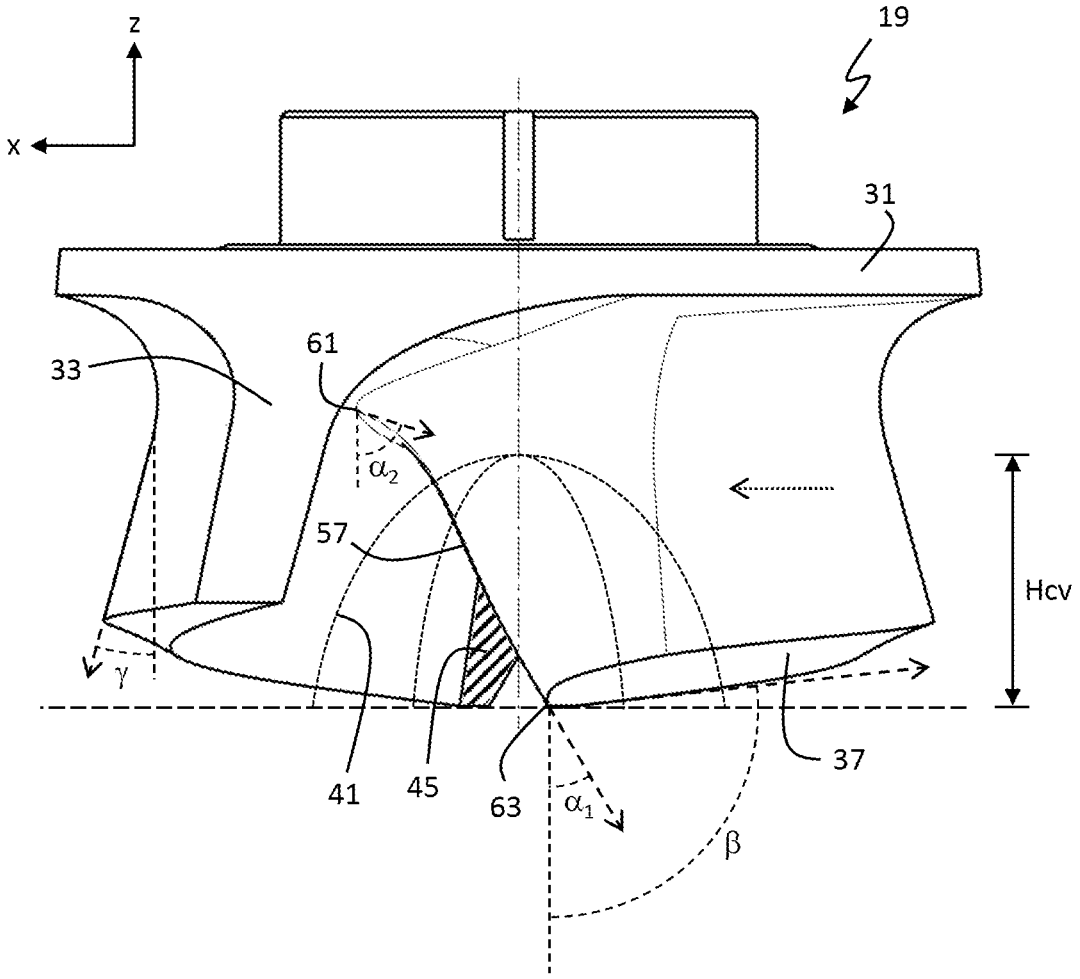
FIG. 6 is a front view of the impeller shown in FIG. 5.

FIGS. 5 and 6 show the specific design of the impeller 19 in more detail. The upper impeller base 31 is essentially a base plate comprising the central hub 23 for fixing the rotor axle 21. The two impeller vanes 33 extend essentially axially downward from the impeller base 31, wherein the impeller base 31 and the impeller vanes 33 are formed as an integrally molded impeller 19. Alternatively, the impeller 19 may comprise one or more than two vanes. In case of two or more vanes, the two impeller vanes 33 are arranged with respect to each other in a rotational symmetry. They are curved in form of a spiral section in the xy-plane perpendicular to the rotor axis R.

The essentially downwardly facing vane ridge surfaces 37 of the impeller vanes 33 are machined in this example and do not extend to the central hub 23 of the impeller base 31. Each vane ridge surface 37 has a circumferentially forward end at a leading edge 57 of the impeller vane 33 and a circumferentially backward end at a trailing edge 59 of the impeller vane 33. The leading edge 57 of each impeller vane 33 may be defined as the path of circumferentially most forward vane surface points, i.e. where the impeller vane 33 hits the pumped fluid first. The trailing edge 57 of each impeller vane 33 may be defined as the path of circumferentially most backward vane surface points, i.e. where the fluid separates from the impeller vane 33 towards the radially outward pressure outlet 17.

The leading edge 57 extends from a leading edge base point 61 at the impeller base 31 to a leading edge ridge point 63 at the vane ridge surface 37, wherein the leading edge 57 is backwardly swept from the leading edge base point 61 to the leading edge ridge point 63. The backward sweep is best seen in FIG. 6. The backward sweep at a point of the leading edge means that a tangent plane at that point is inclined "backward" in circumferential direction of rotation with respect to a plane extending along the rotor axis R and through that point. The backward sweep transports fibrous substances towards the leading edge ridge point 63, where it can be effectively pushed and scraped off by the scraper 39. The leading edge 57 is swept backwardly by a leading edge sweep angle $\alpha_1$ of at least 20° at the leading edge ridge point 63. The leading edge 57 comprises a lower first section 65 and an upper second section 67. The first section 65 extends from the leading edge ridge point 63 upward to the upper second section 67, which ends at the leading edge base point 61. The leading edge sweep angle is larger in the second section 67 than in the first section 65. In particular, the leading edge sweep angle $\alpha_2$ at the leading edge base point 61 is larger than the leading edge sweep angle $\alpha_1$ of at least 20° at the leading edge ridge point 63, e.g. $\alpha_2 \approx 90°$, i.e. there may be effectively no sweep at the leading edge base point 61.

The preferably machined radially innermost vane surface acting as a second scraping path 45 is hatched in FIG. 5. It extends from the central hub 23 to the leading edge ridge point 63. In circumferential forward direction, the second scraping path 45 extends to the first section 65 of the leading edge 57. The second section 67 of the leading edge 57 departs radially outward from the second scraping path 45. Upon impeller rotation, the second scraping path 45 of the impeller vanes 33 describes the dome-shaped central volume 41 into which the scraper 39 can protrude. The dome-shaped central volume 41 is visualized by dashed paths in FIGS. 5 and 6. The dome-shaped central volume 41 is wider towards the suction inlet 15, i.e. downwards, than towards the impeller base 31, i.e. upwards. The bottom radius of the dome-shaped central volume 41 is approximately equal to the inner radius of the inlet sleeve 18, whereas the top radius of the dome-shaped central volume 41 is approximately equal to the inner radius of central hub 23. The depth of the central volume 41 in axial direction in denoted as Hcv in FIG. 6.

The vane ridge surface 37 of each impeller vane 33 is backwardly swept by a sweep angle $\beta$ of more than 90° at the leading edge ridge point 63, so that the height of the impeller vanes 33 reduces from the leading edge ridge point 63 towards the trailing edge 59. In other words, a normal vector of the vane ridge surface 37 has a vector component directed backwardly against circumferential direction of impeller rotation.

The impeller vanes 33 are radially outwardly tilted from the impeller base 31 to the vane ridge surface 37 by a tilt angle $\gamma$ of up to 60°, preferably up to 20°.

Figure 7A:
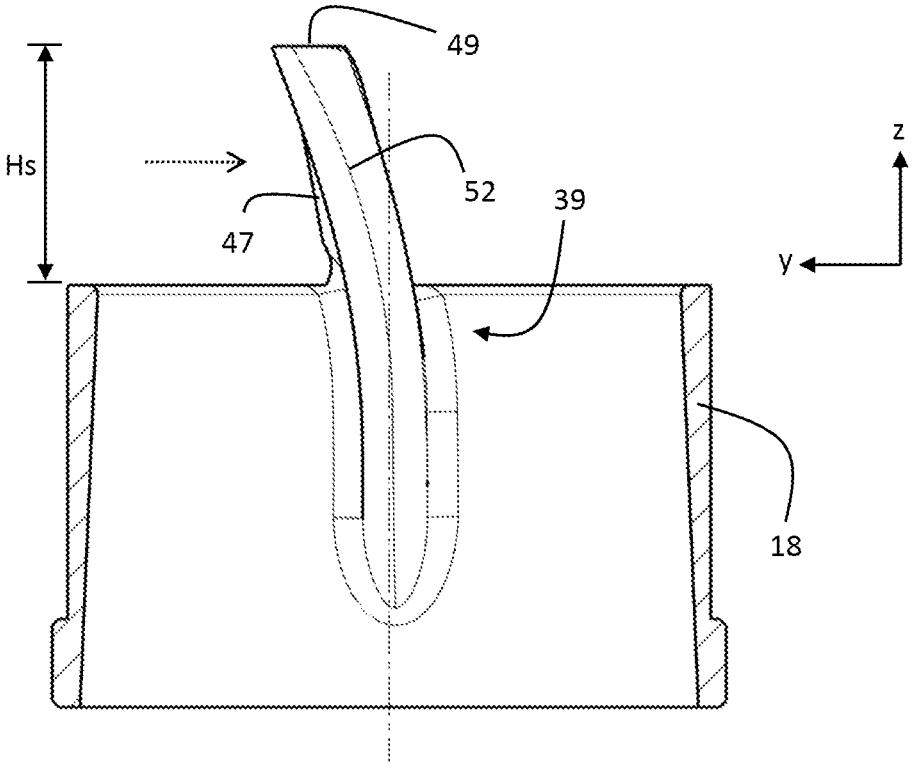
FIG. 7*a* is a sectional front view of a suction inlet with scraper of the embodiment of a centrifugal pump according to the present disclosure.
Figure 7B:
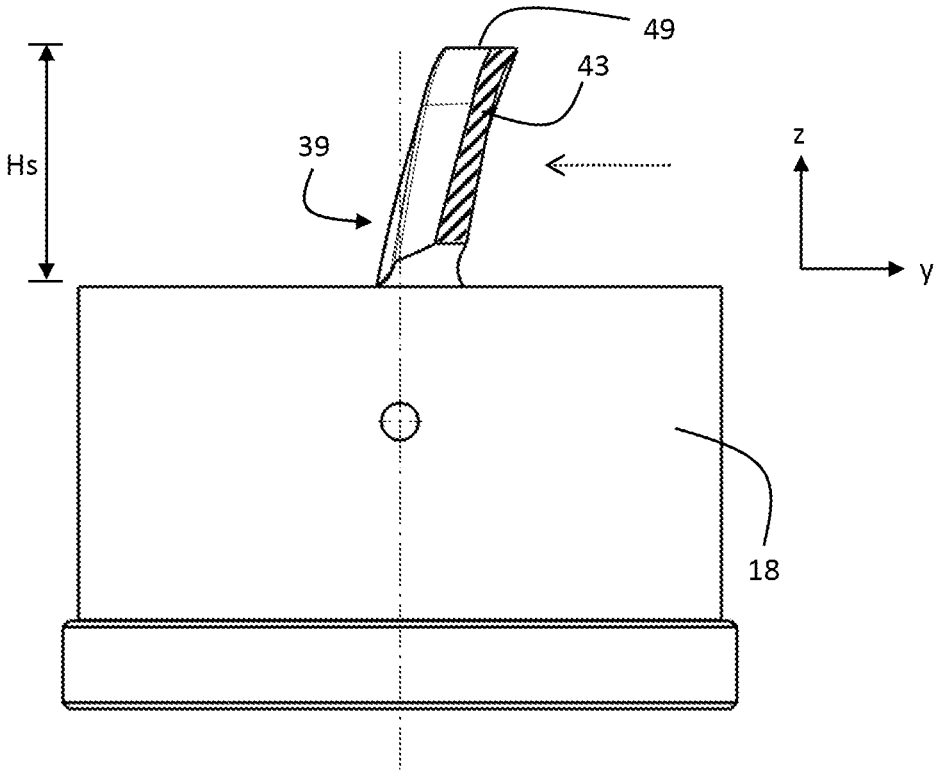
FIG. 7*b* is a sectional rear view, respectively, of a suction inlet with scraper of the embodiment of a centrifugal pump according to the present disclosure.

FIG. 7*a,b* show the scraper 39 in more detail. The scraper 39 is smoothly curved backward from the inlet sleeve 18 towards the upper scraper end 49. The radially outward scraper surface 43 acting as a first scraping path 43 is hatched in FIG. 7*b*. The scraper is long enough to scrape off fibers from the central volume 41. The height of the scraper 39 in axial direction in denoted as Hs in FIG. 7*a,b*. The height Hs is more than 50% of the depth Hcv of the central volume 41 in axial direction as shown in in FIG. 6.

Figure 8A:
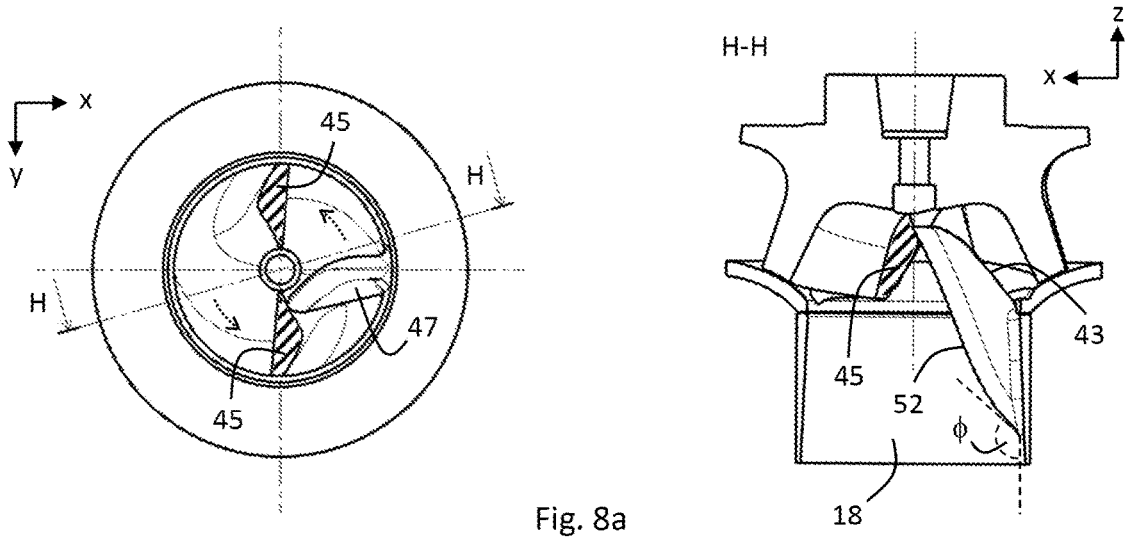
FIG. 8*a* is a view showing the interaction of an impeller vane with a scraper according to the present disclosure in an angular position of the impeller during rotation, wherein the figure on the left is a bottom view and the figure on the right is a corresponding sectional view on plane H-H as outlined in the figure on the left.
Figure 8B:
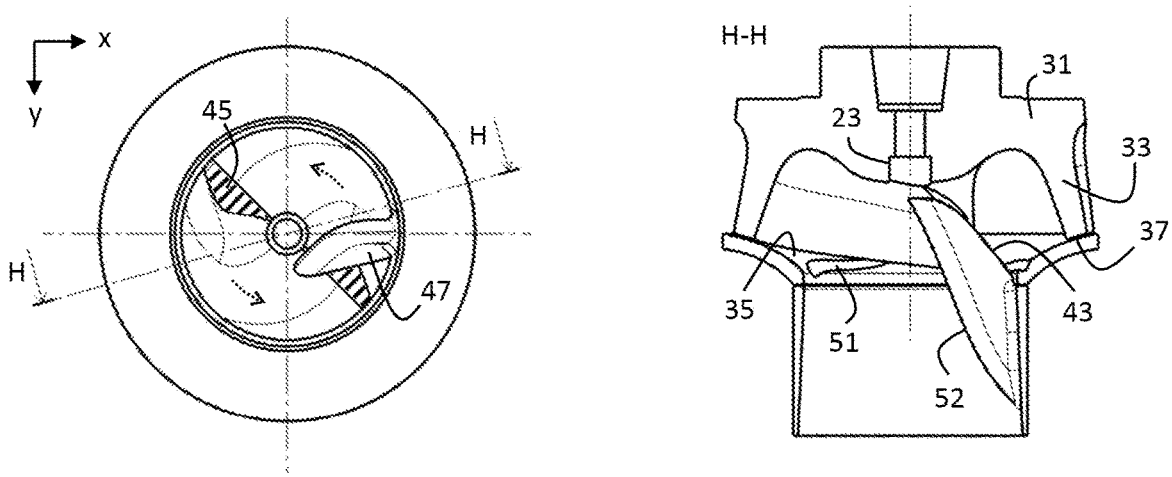
FIG. 8*b* is a view showing the interaction of an impeller vane with a scraper according to the present disclosure in a different angular position of the impeller during rotation, wherein the figure on the left is a bottom view and the figure on the right is a corresponding sectional view on plane H-H as outlined in the figure on the left.
Figure 8C:
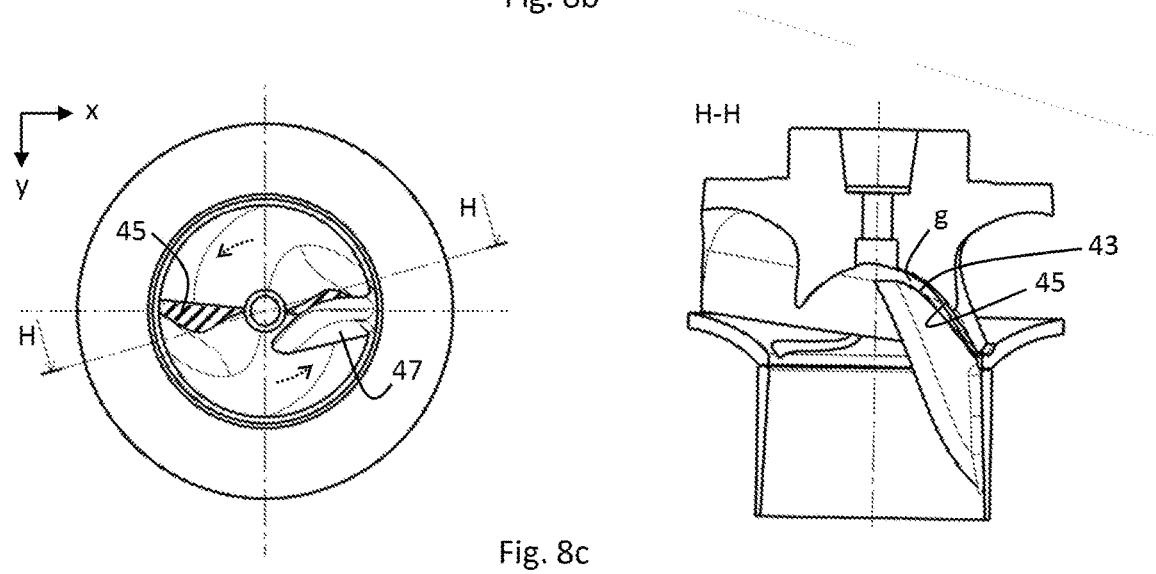
FIG. 8*c* is a view showing the interaction of an impeller vane with a scraper according to the present disclosure in a different angular position of the impeller during rotation, wherein the figure on the left is a bottom view and the figure on the right is a corresponding sectional view on plane H-H as outlined in the figure on the left.

FIGS. 8*a-c* show on the left bottom views through the inlet sleeve 18 on the impeller 19 at different angular positions during impeller rotation. In FIG. 8*a*, the second scraping path 45 of one of the impeller vanes 33 starts interacting with the stationary scraper 39. In FIG. 8*b*, the impeller 19 is rotated further by about 45° so that the second scraping path 45 is in the process of passing by the scraper 39. In FIG. 8*c*, the impeller 19 is rotated further by about another 45° so that the second scraping path 45 has just fully passed the first scraping path 43 of the scraper 39. The sectional view on plane H-H on the right of FIG. 8*c* shows that the second scraping path 45 and the first scraping path 43 of the scraper 39 are essentially parallel for a moment with the scrape gap g between them. The scrape gap g is essentially constant along the scraper 39 or increases slightly towards the impeller base 31.

In FIG. 8*a* on the right, a scraper connection angle φ in the range of 110° to 170° is displayed. The scraper 39 comprises a scraper ridge 52 which the upward flowing fluid hits first, i.e. it acts as a static scraper leading edge. The scraper ridge 52 is a path on a rounded scraper surface from the inlet sleeve 18 to the scraper end 49, whereby the fluidic resistance of the scraper is reduced. In order to prevent fibrous substances from getting entangled at the scraper ridge 52, the scraper ridge 52 is swept in the direction of fluid flow by the scraper sweep angle, which is mostly larger than the scraper connection angle γ and mostly increases towards the scraper end 49. The scraper connection angle γ may be defined by the obtuse angle between a tangent at the radially outermost point of the scraper ridge and an axis parallel to the rotor axis through that point. The scraper sweep angle may be analogously defined for any point along the scraper ridge.

FIG. 9 shows a top view on the cover surface 35 with three grooves 51 that may be identical and arranged in a three-fold rotational symmetry, i.e. at an angular distance of 120° to each other. Each groove 51 extends from a groove inlet port 53 at an inner radius $r_1$ of the cover surface 35 at a first angular position $\varphi_1$ to a groove outlet port 55 at an outer radius $r_2$ of the cover surface 35 at a second angular position $\varphi_2$. The second angular position $\varphi_2$ is further forward in the direction of impeller rotation. A radially inner first section 69 of the grooves 51, is curved in form of a spiral section with a relatively slow radial growth of $$\frac{dr}{d\varphi} \leq \frac{r_a - r_i}{45°}.$$

A radially outer second section 71 of the grooves 51, is curved in form of a spiral section with a relatively fast radial growth of $$\frac{dr}{d\varphi} \geq \frac{r_a - r_i}{20°}.$$

There is a "knee" 73 in the grooves 51 between the first section 69 and the second section 71. This is advantageous to reduce the time needed for fibrous substances to travel along the grooves 51.

The position of the scraper 39 relative to the grooves 51 is indicated by dashed lines in FIGS. 9 and 10. The guiding surface 47 of the scraper 39 is not far behind one of the a groove inlet ports 53, i.e. at an angular distance $\theta_1$ of less than 90° forward in circumferential direction of impeller rotation, so that the fibrous substances agglomerated at the guiding surface 47 can easily enter the groove 51. The angular size $\theta_2$ of the groove inlet ports 53 extending from a first angular end 72 to a second angular end 74 is less than 90°. The guiding surface 47 of the scraper 39 may have a distance $\theta_1$-$\theta_2$ to the second end 74, which is located behind the first angular end 72 in circumferential direction of impeller rotation. Preferably, the distance $\theta_1$-$\theta_2$ is small (see FIG. 10) or zero (see FIG. 15*b*).

FIG. 10 shows a top view on an alternative embodiment of the cover surface 35 with two essentially identical grooves 51 arranged in a two-fold rotational symmetry, i.e. at an angular distance of 180° to each other. The grooves 51 follow one long spiral path from the groove inlet port 53 to the groove outlet port 55 with an average radial growth of $$\frac{dr}{d\varphi} \leq \frac{r_a - r_i}{120°}.$$

The width and/or depth of the grooves 51 increases from the groove inlet port 53 towards the groove outlet port 55.

Figure 11A:
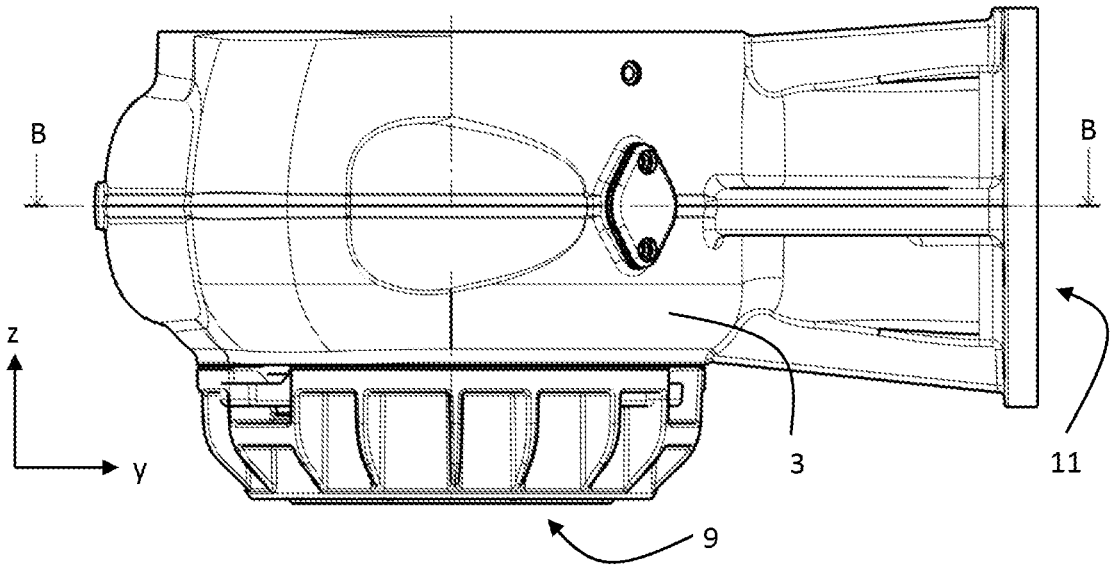
FIG. 11*a* is a rear view of the pump housing.
Figure 11B:
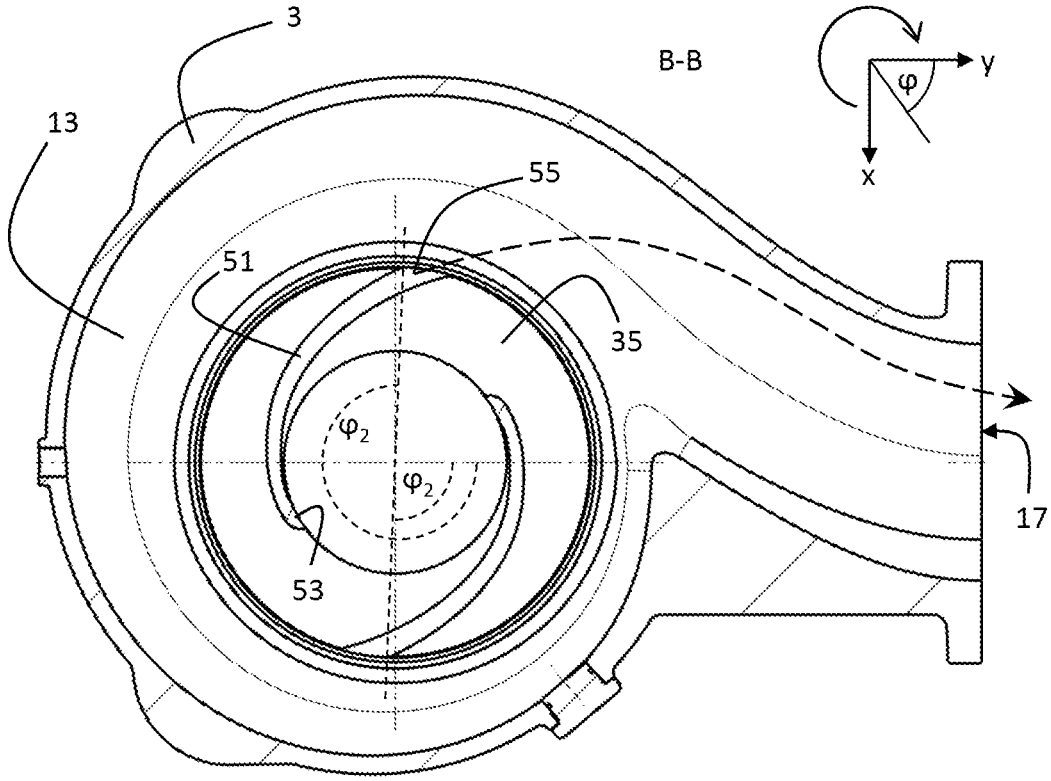
FIG. 11*b* is a cross-sectional view on plane B-B as outlined in FIG. 11*a* with the cover surface as shown in FIG. 10.

As shown in FIG. 11*a,b*, the grooves 51 are arranged in a certain position relative to the pressure outlet 17, so that the groove outlet ports 55 have an angular position $\varphi_2$ in the range $20° \leq \varphi_2 \leq 310°$, wherein an angular position of $\varphi_2 = 0°$ corresponds to the angular position of the pressure outlet 17. The fibrous substances then follow a path as indicated in FIG. 11*b* by a dashed arrow from the groove outlet port 55 to the pressure outlet 17.

Figure 12A:
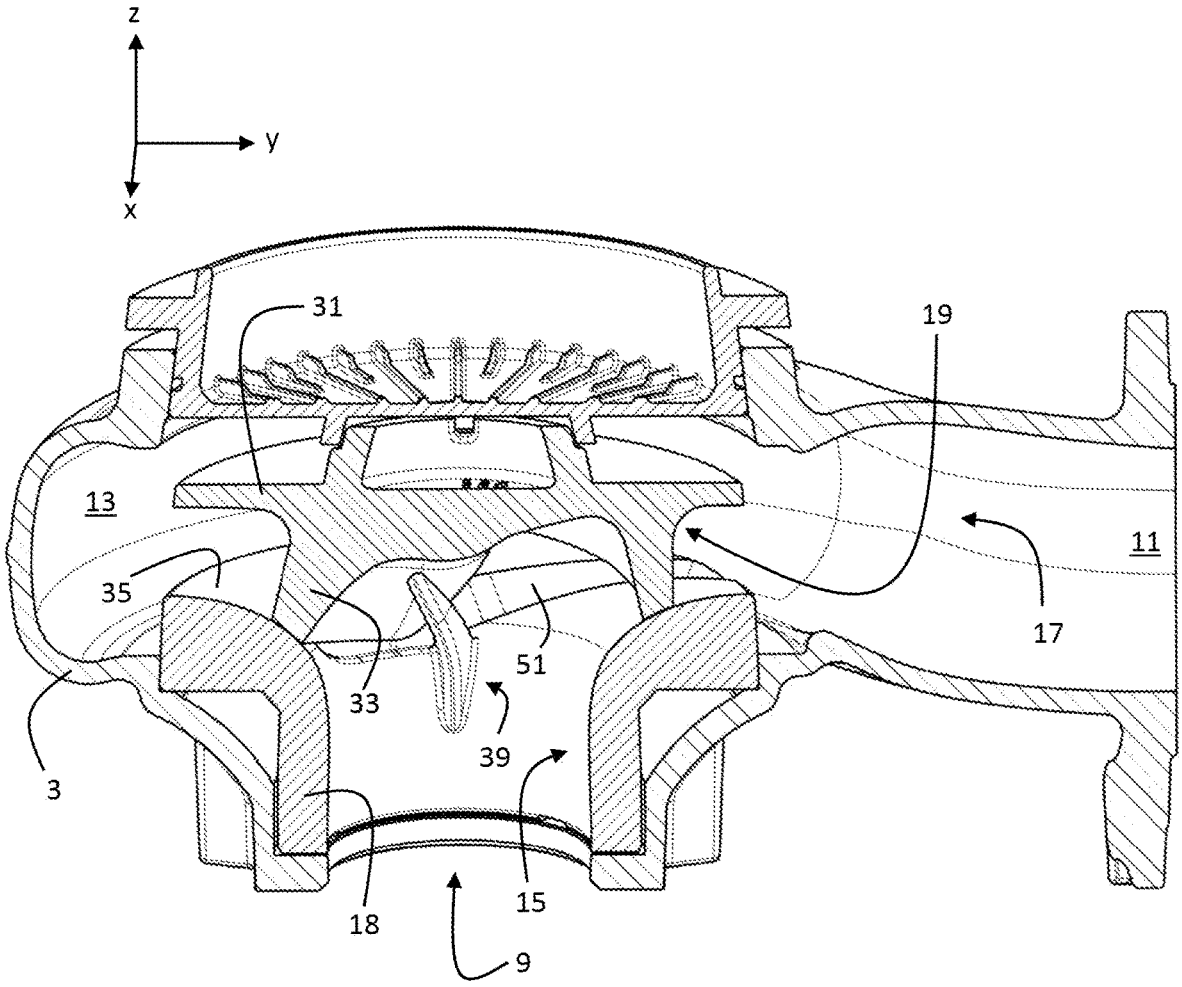
FIG. 12*a* is a sectional partial view of another embodiment of a centrifugal pump according to the present disclosure.
Figure 12B:
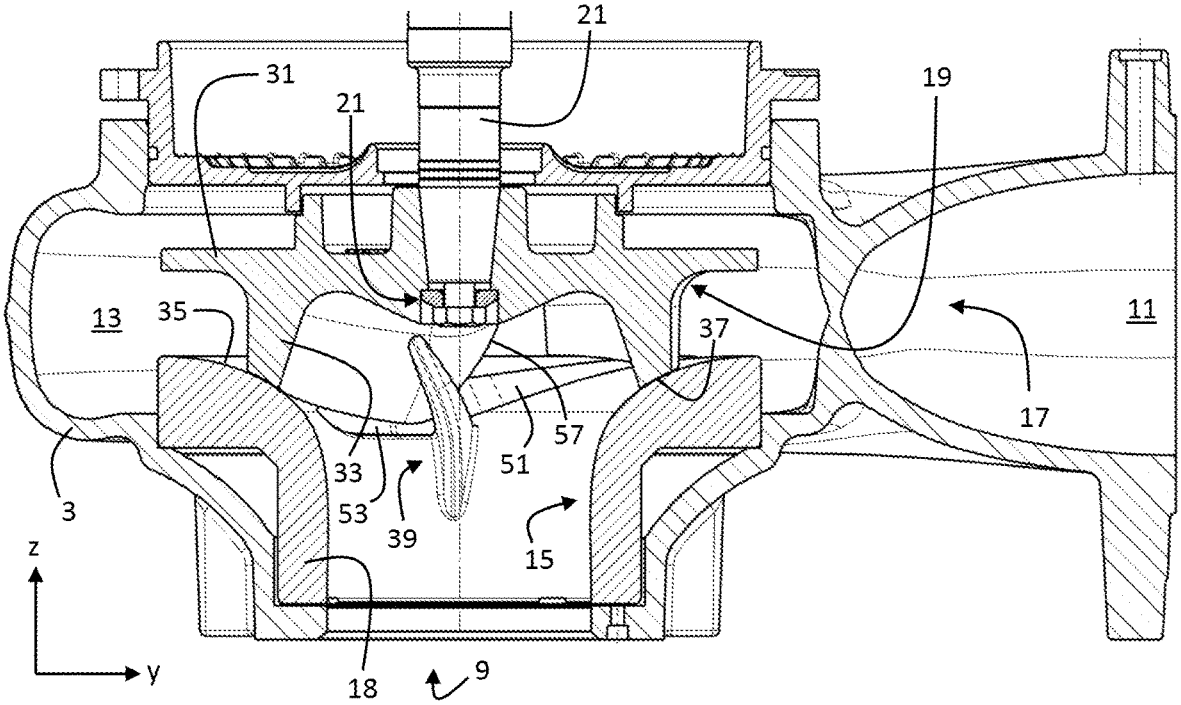
FIG. 12*b* is a sectional partial view of the another embodiment of the centrifugal pump according to the present disclosure.
Figure 12C:
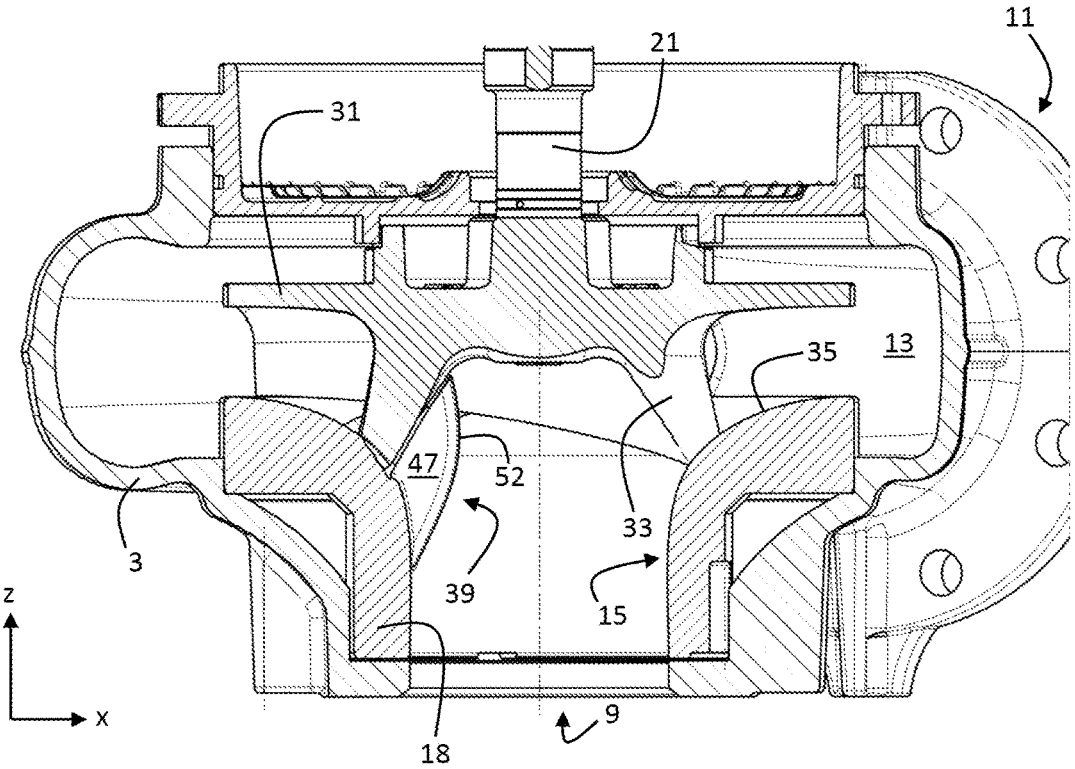
FIG. 12*c* is a sectional partial view of the another embodiment of the centrifugal pump according to the present disclosure.

FIGS. 12*a-c* show another embodiment of the centrifugal pump 1, which have the most aspects and features in common with the previously described embodiment, but differs in some aspects and features. Firstly, in contrast to the previously described embodiment, the suction inlet 15 is here formed as an integral part by the suction sleeve 18, the suction cover including the suction cover surface 35 and the groove 51 and the scraper 39. Such an integral design may reduce the diversity of parts as well as the construction and assembly complexity. In this embodiment, the scrape gap g and the cover gap h may not be individually adjustable, but only together or not at all. Secondly, the embodiment differs from the previously described embodiment in that the suction cover only comprises one single groove 51, which is wider and deeper than the previously described grooves 51. As can be seen in more detail in FIGS. 15*a-c*, the relatively large groove inlet port 53 is located directly at the scraper 39. Also, the angular position of the scraper 39 within the pump housing 3 is rotated by 180°. Finally, the shape of the impeller vanes 33 differs in some aspects. For instance, the radially innermost vane path 45 is not part of a machined surface, but a path on a smoothly curved non-machined radially inner vane surface (see FIGS. 13*a-c*). This has the advantage that the risk of cavitation effects is reduced by a fluid-dynamically optimized vane shape with less machined sharp edges. Also the first scraping path 43 on the scraper 39 may be a path on a non-machined surface rather than a machined first scraping surface.

Figure 13A:
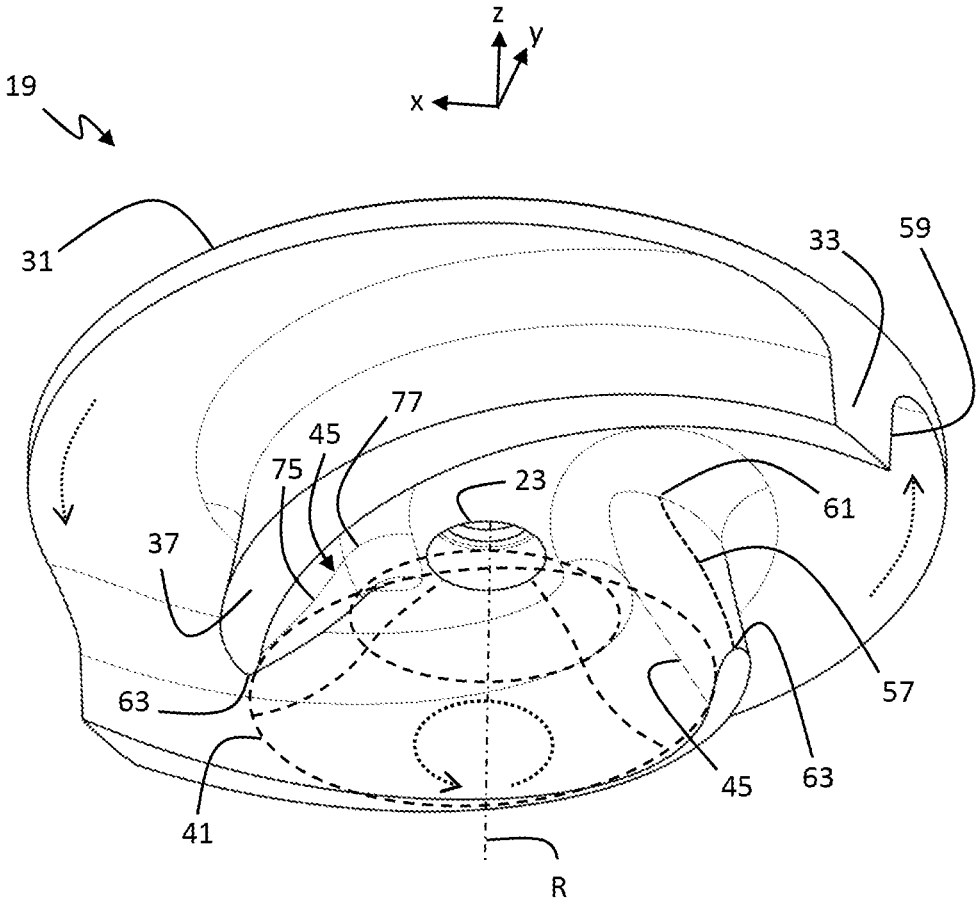
FIG. 13*a* is a view of an impeller of a centrifugal pump according to the embodiment shown in FIGS. 12*a-c;*

As can be seen in FIG. 13*a,b*, the leading edge 57 has here no surface points in common with the radially innermost vane path 45. This means that the leading edge has a distance in radial and circumferential direction from the radially innermost vane path 45. This is fluid-dynamically beneficial and still effective to scrape off fibers, because tests have shown that the scraper 39 is physically most effective to transport fibers from the impeller base 31 towards the vane ridge 37. Once the fibers have reached a certain distance from the impeller base 31, the fibers automatically find their way towards the groove inlet port 53. It is further advantageous that the distance in radial and/or circumferential direction between the leading edge 57 and the radially innermost vane path 45 increases towards the impeller base 31. In other words, the distance decreases away from the impeller base 31, which facilitates guiding the fibers into the groove inlet port 53.

As can be seen in FIG. 13*a,b*, the radially innermost vane path 45 comprises a first section 75 having a convex shape and a second section 77 having a concave shape. The second section 77 is closer to the impeller base 31 than the first section 75. This results in a bell-shaped central volume 41 as the virtual surface of revolution defined by rotation of the radially innermost vane path 45. Consequently, a longitudinal cut of the central volume 41 is concave where the radially innermost vane path 45 is convex and vice versa. Such as bell-shape of the central volume 41 has shown to perform very well for transporting off fibers into the groove inlet port 53.

Figure 13B:
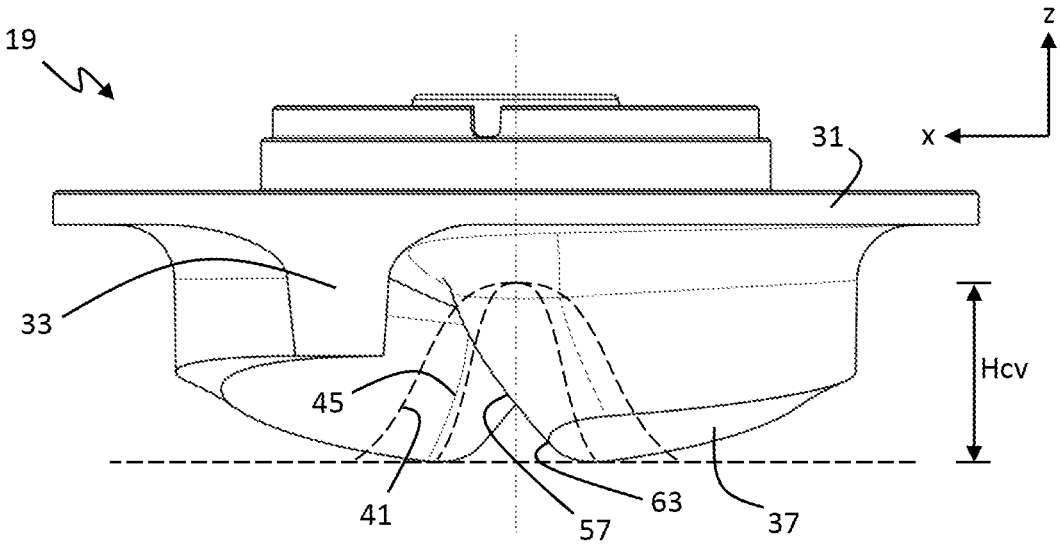
FIG. 13*b* is another view of an impeller of a centrifugal pump according to the embodiment shown in FIGS. 12*a-c;*
Figure 14A:
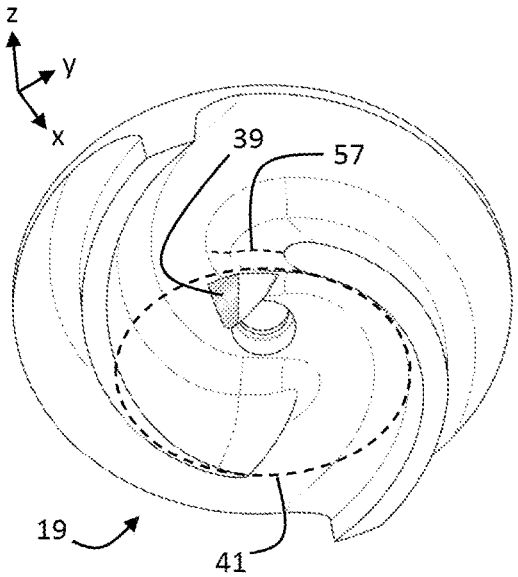
FIG. 14*a* is a perspective view of the impeller shown in FIG. 13*a,b* in a rotational position relative to the scraper.
Figure 14B:
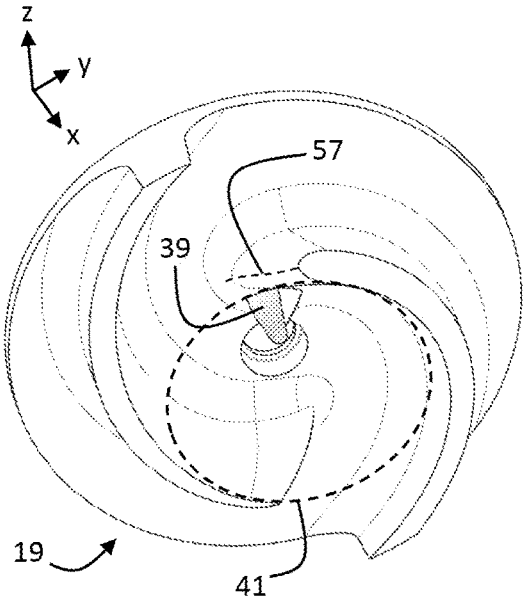
FIG. 14*b* is a perspective view of the impeller shown in FIG. 13*a,b* in another rotational position relative to the scraper.
Figure 14C:
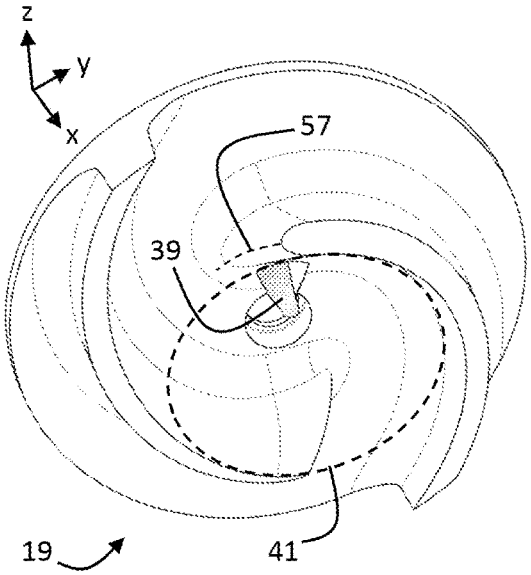
FIG. 14*c* is a perspective view of the impeller shown in FIG. 13*a,b* in yet another rotational position relative to the scraper.
Figure 14D:
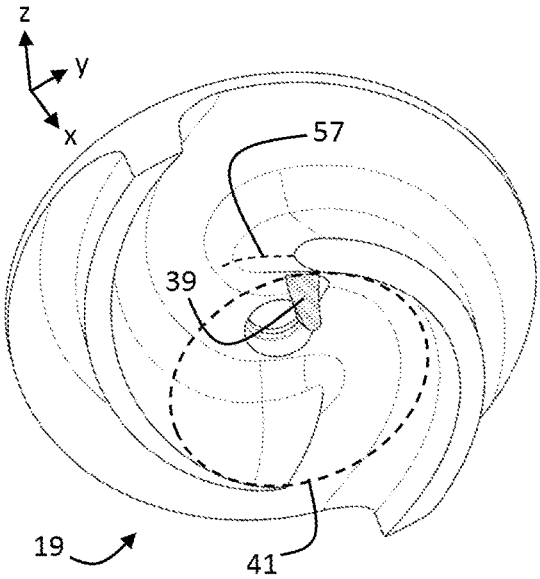
FIG. 14*d* is a perspective view of the impeller shown in FIG. 13*a,b* in yet another rotational position relative to the scraper.
Figure 15A:
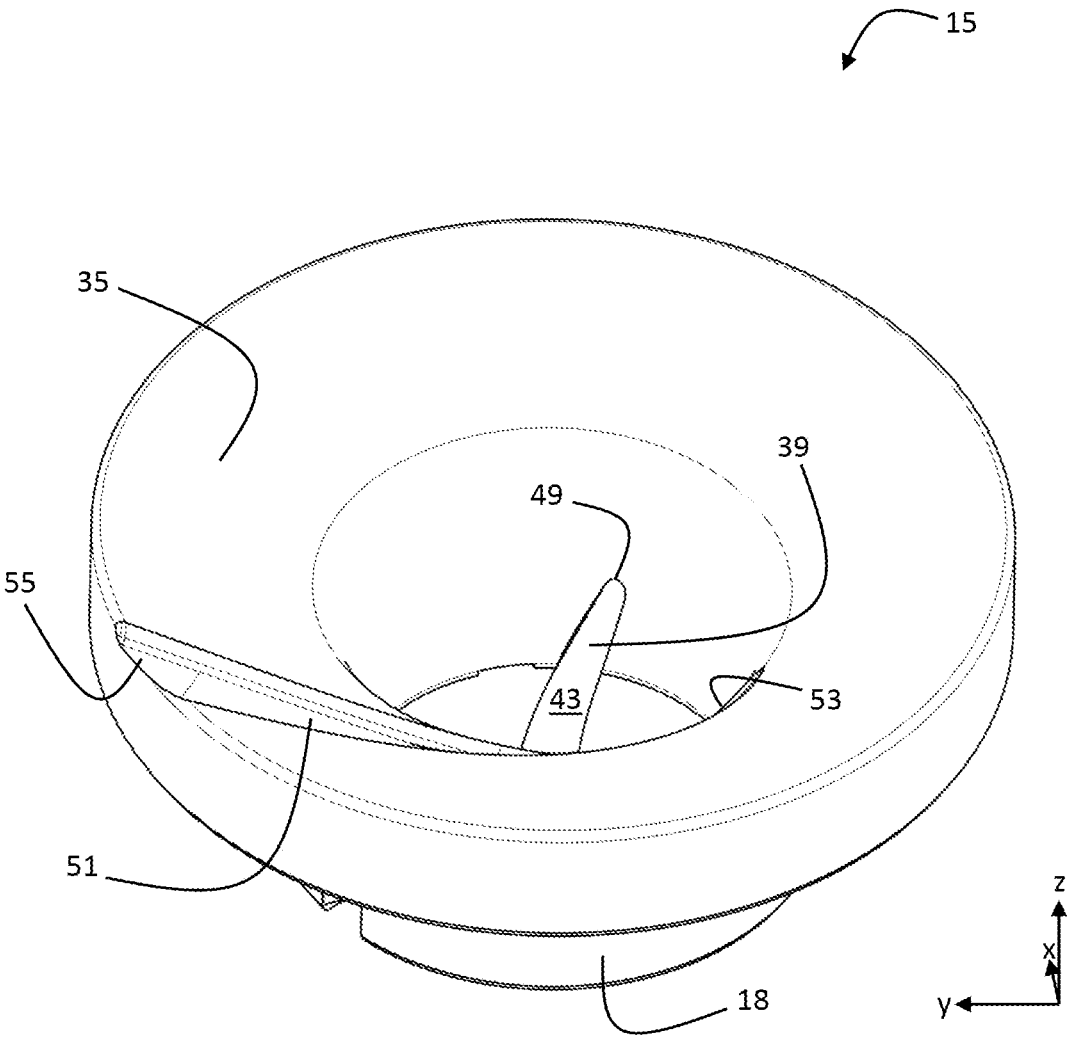
FIG. 15*a* is a view of a suction inlet including a cover surface of a centrifugal pump according to the embodiment shown in FIGS. 12*a-c;*
Figure 15B:
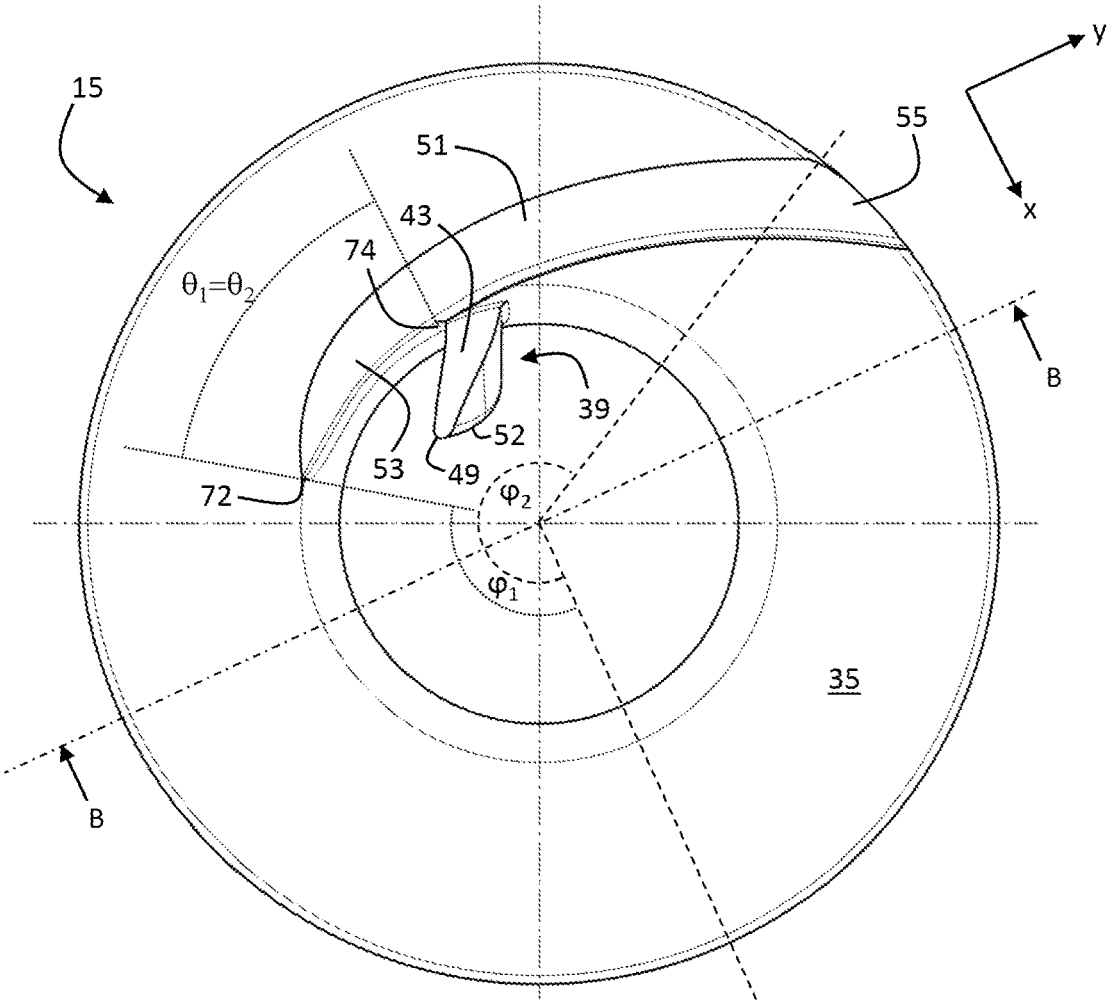
FIG. 15*b* is a different view of a suction inlet including a cover surface of a centrifugal pump according to the embodiment shown in FIGS. 12*a-c;*
Figure 15C:
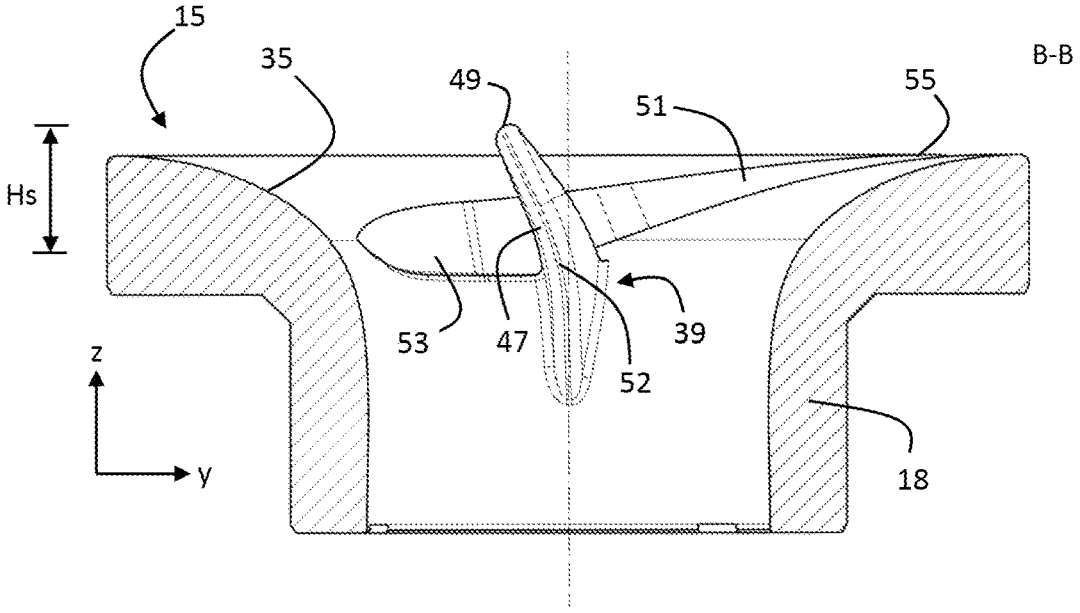
FIG. 15*c* is a different view of a suction inlet including a cover surface of a centrifugal pump according to the embodiment shown in FIGS. 12*a-c;*

Similar to the embodiment shown in FIGS. 6 and 7, the height Hs of the at least one scraper 39 in axial direction is at least 50% of the depth Hcv of the central volume 41 in axial direction (see FIG. 13*b* and 15*c*). This is beneficial to guide fibers that are located close to the impeller base 31 towards the groove inlet port 53.

FIGS. 14*a-d* illustrate in different angular positions of the impeller 19 relative to the scraper 39 the distance in radial and/or circumferential direction between the leading edge 57 and the radially innermost vane path 45. So, the leading edge 57 and the radially innermost vane path 45 are completely separate surface paths.

FIGS. 15*a-c* show the integral suction inlet 15, preferably as an integrally molded part, in more detail. The relatively large groove inlet port 53 has an angular size of $45° < \theta_2 < 90°$. As the guiding surface 47 of the scraper 39 is directly located at the second angular end 74 of the groove inlet port 53, the angular distance $\theta_1$-$\theta_2$ is zero.

Figure 16A:
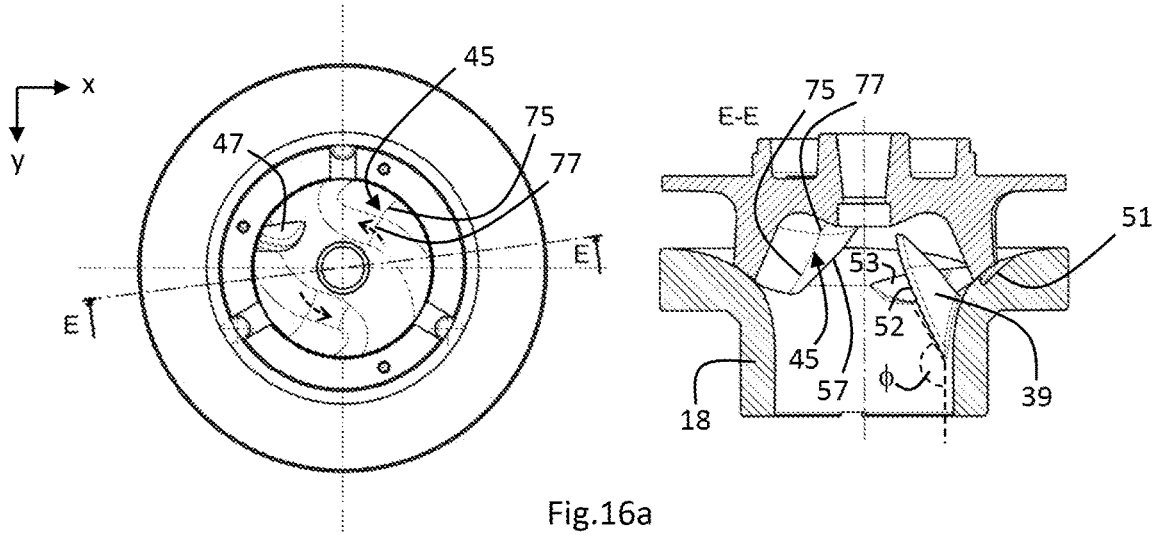
FIG. 16*a* is a view showing the interaction of an impeller vane with a scraper according to the embodiment shown in FIGS. 12*a-c* in different angular positions of the impeller during rotation, wherein the figure on the left is a bottom view and the figure on the right is a corresponding sectional view on plane E-E as outline in the figure on the left.
Figure 16B:
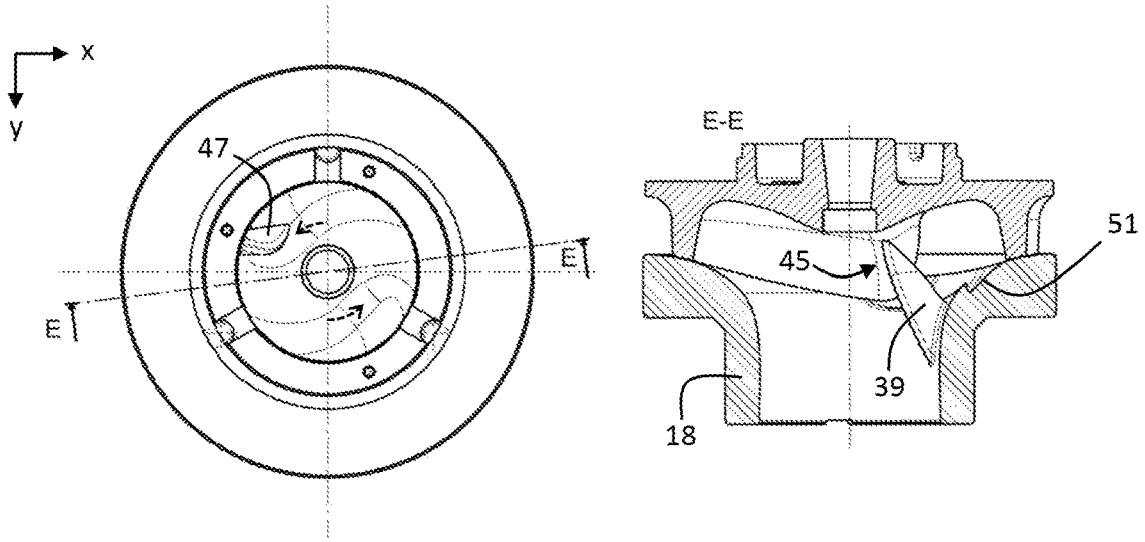
FIG. 16*b* is a view showing the interaction of an impeller vane with a scraper according to the embodiment shown in FIGS. 12*a-c* in different angular positions of the impeller during rotation, wherein the figure on the left is a bottom view and the figure on the right is a corresponding sectional view on plane E-E as outline in the figure on the left.
Figure 16C:
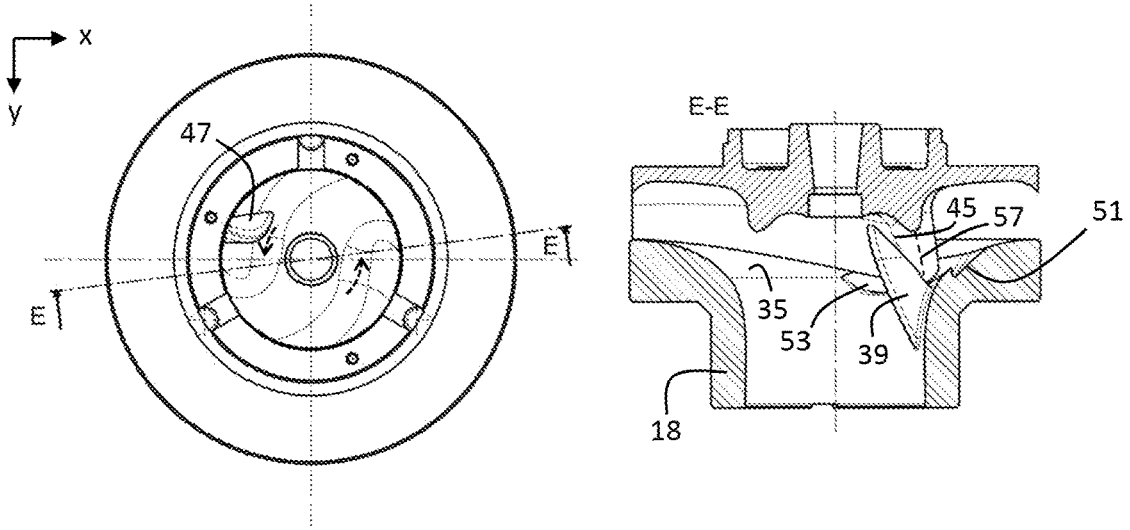
FIG. 16*c* is a view showing the interaction of an impeller vane with a scraper according to the embodiment shown in FIGS. 12*a-c* in different angular positions of the impeller during rotation, wherein the figure on the left is a bottom view and the figure on the right is a corresponding sectional view on plane E-E as outline in the figure on the left.

Analogous to FIGS. 8*a-c*, FIGS. 16*a-c* show the functioning of the embodiment according to FIGS. 12*a-c* in different angular positions of the impeller 19. FIGS. 16*a-c* show on the left bottom views through the inlet sleeve 18 on the impeller 19 at different angular positions during impeller rotation (counter-clockwise in FIGS. 16*a-c* on the left). In FIG. 16*a*, the second scraping path 45 of one of the impeller vanes 33 is positioned about 90° before the stationary scraper 39. In FIG. 16*b*, the impeller 19 is rotated further by about 45° so that the second scraping path 45 is closer to passing by the scraper 39. In FIG. 16*c*, the impeller 19 is rotated further by about another 45° so that the second scraping path 45 is in the process of passing the first scraping path 43 of the scraper 39. The sectional view on plane E-E on the right of FIG. 16*c* shows that the first scraping path 43 of the scraper 39 scrapes off fibers from the second section 77 of the second scraping path 45 before it scrapes off fibers from the first section 75 of the second scraping path 45. This achieved by the inclination of the scraper 39 against the rotation direction (see FIG. 15*c*) and facilitates the fiber transport towards the groove inlet port 53. The scrape gap g, however, is essentially constantly about 1 mm along the scraper 39.

In FIG. 16*a* on the right, the scraper connection angle $\gamma$ in the range of 110° to 170° is displayed. The scraper 39 comprises a scraper ridge 52 which the upward flowing fluid hits first, i.e. it acts as a static scraper leading edge. The scraper ridge 52 is a path on a rounded scraper surface from the inlet sleeve 18 to the scraper end 49, whereby the fluidic resistance of the scraper is reduced. In order to prevent fibrous substances from getting entangled at the scraper ridge 52, the scraper ridge 52 is swept in the direction of fluid flow by the scraper sweep angle, which is mostly larger than the scraper connection angle $\gamma$ and mostly increases towards the scraper end 49. The scraper connection angle $\gamma$ may be defined by the obtuse angle between a tangent at the radially outermost point of the scraper ridge and an axis parallel to the rotor axis through that point. The scraper sweep angle may be analogously defined for any point along the scraper ridge.

Where, in the foregoing description, integers or elements are mentioned which have known, obvious or foreseeable equivalents, then such equivalents are herein incorporated as if individually set forth. Reference should be made to the claims for determining the true scope of the present disclosure, which should be construed so as to encompass any such equivalents. It will also be appreciated by the reader that integers or features of the disclosure that are described as optional, preferable, advantageous, convenient or the like are optional and do not limit the scope of the independent claims.

The above embodiments are to be understood as illustrative examples of the disclosure. It is to be understood that any feature described in relation to any one embodiment may be used alone, or in combination with other features described, and may also be used in combination with one or more features of any other of the embodiments, or any combination of any other of the embodiments. While at least one exemplary embodiment has been shown and described, it should be understood that other modifications, substitutions and alternatives are apparent to one of ordinary skill in the art and may be changed without departing from the scope of the subject matter described herein, and this application is intended to cover any adaptations or variations of the specific embodiments discussed herein.

In addition, "comprising" does not exclude other elements or steps, and "a" or "one" does not exclude a plural number. Furthermore, characteristics or steps which have been described with reference to one of the above exemplary embodiments may also be used in combination with other characteristics or steps of other exemplary embodiments described above. Method steps may be applied in any order or in parallel or may constitute a part or a more detailed version of another method step. It should be understood that there should be embodied within the scope of the patent warranted hereon all such modifications as reasonably and properly come within the scope of the contribution to the art. Such modifications, substitutions and alternatives can be made without departing from the spirit and scope of the disclosure, which should be determined from the appended claims and their legal equivalents.

While specific embodiments of the invention have been shown and described in detail to illustrate the application of the principles of the invention, it will be understood that the invention may be embodied otherwise without departing from such principles.

LIST OF REFERENCE NUMERALS

1 pump
3 pump housing
5 motor housing
7 electronics housing
9 fluid inlet
11 fluid outlet
13 pump chamber
15 suction inlet
17 pressure outlet
18 inlet sleeve
19 impeller
21 rotor axle
23 central hub
31 impeller base
33 impeller vanes
35 cover surface
37 vane ridge surface
39 scraper

41 central volume
43 first scraping path of scraper
45 second scraping path of impeller vanes
47 guiding surface
49 scraper end
51 groove(s)
52 scraper ridge
53 groove inlet port
55 groove outlet port
57 leading edge
59 trailing edge
61 leading edge base point
63 leading edge ridge point
65 first section of leading edge
67 second section of leading edge
69 first section of the groove(s)
71 second section of the groove(s)
72 first angular end of groove inlet port
73 knee of the groove(s)
74 second angular end of groove inlet port
75 first section of second scraping path
77 second section of second scraper path
g scrape gap
h cover gap
$\alpha$ leading edge sweep angle
$\alpha_1$ leading edge sweep angle at leading edge ridge point
$\alpha_z$ leading edge sweep angle at leading edge base point
$\beta$ sweep angle of vane ridge surface
$\gamma$ tilt angle of impeller vanes
$\varphi$ scraper connection angle
$r_1$ inner radius of cover surface
$r_2$ outer radius of cover surface
$\varphi_1$ first angular position of groove inlet port(s)
$\varphi_2$ second angular position of groove outlet port(s)
$\theta_1$ angular distance between guiding surface and groove inlet port
$\theta_2$ angular size of groove inlet port
Hs height of the scraper in axial direction
Hcv depth of the central volume in axial direction

The invention claimed is:

1. A centrifugal pump comprising:

a pump housing enclosing a pump chamber, wherein the pump chamber comprises a suction inlet and a pressure outlet;

an impeller rotatably arranged within the pump chamber for being driven to rotate about a rotor axis, wherein the suction inlet is located coaxial with the rotor axis; and at least one stationary scraper wherein the impeller comprises an impeller base and one or more vanes extending from the impeller base towards the suction inlet, wherein each of the impeller vanes comprises a radially innermost vane path describing during impeller rotation a central volume that is wider towards the suction inlet than towards the impeller base and that is configured to receive the at least one stationary scraper projecting from the suction inlet into the central volume, wherein each of the impeller vanes comprises a leading edge extending from a leading edge base point at the impeller base to a leading edge ridge point at a vane ridge surface, wherein the leading edge is backwardly swept from the leading edge base point to the leading edge ridge point, wherein the leading edge has a distance in radial and/or circumferential direction from the radially innermost vane path, each of the one or more vanes has a concave surface directed radially inward toward the rotor axis.

2. The centrifugal pump according to claim 1, wherein the at least one stationary scraper comprises a radially outward scraper surface acting as a first scraping path and positioned to form a scrape gap to the radially innermost vane path acting as a second scraping path during impeller rotation.

3. The centrifugal pump according to claim 2, wherein the scrape gap is in the range of 0.1 to 5 mm.

4. The centrifugal pump according to claim 2, wherein the scrape gap is constant or varies along the radially innermost vane path.

5. The centrifugal pump according to claim 1, wherein the at least one stationary scraper is mounted to or an integral part of the suction inlet at a scraper connection angle in the range of 110° to 170°.

6. The centrifugal pump according to claim 1, wherein the at least one stationary scraper comprises a guiding surface facing backward in a circumferential direction of impeller rotation, and wherein the guiding surface is inclined against the circumferential direction of impeller rotation from the suction inlet towards the impeller base.

7. The centrifugal pump according to claim 1, wherein the at least one stationary scraper extends straight in an axial direction.

8. The centrifugal pump according to claim 1, wherein the vane ridge surface of each impeller vane faces towards a cover surface of the suction inlet, wherein the impeller is positioned relative to the cover surface to form a cover gap between the vane ridge surface and the cover surface.

9. The centrifugal pump according to claim 8, wherein the cover gap is in the range of 0.1 to 1 mm.

10. The centrifugal pump according to claim 8, wherein the cover surface comprises at least one groove extending from a groove inlet port at an inner radius of the cover surface to a groove outlet port at an outer radius of the cover surface.

11. The centrifugal pump according to claim 10, wherein the groove inlet port extends between a first angular end and a second angular end, wherein the first angular end and the second angular end have an angular distance of less than 90° to each other, wherein the second angular end is located behind the first angular end in a circumferential direction of impeller rotation, wherein the at least one stationary scraper is located at the second angular end.

12. The centrifugal pump according to claim 1, wherein the leading edge is swept backwardly by a leading edge sweep angle of at least 20° at the leading edge ridge point.

13. The centrifugal pump according to claim 12, wherein the leading edge sweep angle is larger at the leading edge base point than at the leading edge ridge point, wherein the leading edge sweep angle is least 20° between the leading edge base point and the leading edge ridge point.

14. The centrifugal pump according to claim 1, wherein the distance in at least one of the radial direction and the circumferential direction between the leading edge and the radially innermost vane path increases towards the impeller base.

15. The centrifugal pump according to claim 1, wherein each of the impeller vanes is radially outwardly tilted from the impeller base to the vane ridge surface by a tilt angle of up to 60°.

16. The centrifugal pump according to claim 1, wherein the radially innermost vane path comprises a first section having a convex shape and a second section having a concave shape.

17. The centrifugal pump according to claim 1, wherein a height in an axial direction of the at least one stationary scraper is at least 50% of a depth in an axial direction of the central volume.

18. A centrifugal pump comprising:

a pump housing enclosing a pump chamber, wherein the pump chamber comprises a suction inlet and a pressure outlet;

an impeller rotatably arranged within the pump chamber for being driven to rotate about a rotor axis, wherein the suction inlet is located coaxial with the rotor axis; and at least one stationary scraper wherein the impeller comprises an impeller base and one or more vanes extending from the impeller base towards the suction inlet, wherein each of the impeller vanes comprises a radially innermost vane path describing during impeller rotation a central volume that is wider towards the suction inlet than towards the impeller base and that is configured to receive the at least one stationary scraper projecting from the suction inlet into the central volume, the radially innermost vane path comprises a first section having a convex shape and a second section having a concave shape, each of the one or more vanes has a convex surface being directed radially outward away from the rotor axis.

* * * * *